US007354180B2

(12) United States Patent
Sawhney et al.

(10) Patent No.: US 7,354,180 B2
(45) Date of Patent: Apr. 8, 2008

(54) RAPID DISPATCH EMERGENCY SIGNS

(75) Inventors: Ravl K. Sawhney, Calabasas, CA (US); Kurt Botsai, Thousand Oaks, CA (US); Lance G. Hussey, Simi Valley, CA (US); Craig R. Steele, Los Angeles, CA (US); Simon Risley, Ventura, CA (US); Michael S. Schuffert, Canoga Park, CA (US)

(73) Assignee: RKS Design, Inc., Thousand Oaks, CA (US)

( * ) Notice: Subject to any disclaimer, the term of this patent is extended or adjusted under 35 U.S.C. 154(b) by 0 days.

(21) Appl. No.: 11/182,456

(22) Filed: Jul. 15, 2005

(65) Prior Publication Data

US 2005/0278998 A1 Dec. 22, 2005

Related U.S. Application Data

(63) Continuation of application No. 11/079,474, filed on Mar. 15, 2005.

(60) Provisional application No. 60/619,966, filed on Oct. 20, 2004, provisional application No. 60/552,714, filed on Mar. 15, 2004.

(51) Int. Cl.

| | |
|---|---|
| ***G09F 19/22*** | (2006.01) |
| ***G09F 13/00*** | (2006.01) |
| ***G09F 21/14*** | (2006.01) |
| ***F21L 14/04*** | (2006.01) |

(52) U.S. Cl. ..... 362/388; 362/542; 362/238; 362/240; 362/250; 362/413; 362/414; 362/419; 362/431

(58) Field of Classification Search ..... 362/388, 362/542, 238, 240, 244, 250, 413, 414, 419, 362/431, 812, 800; 40/550, 541, 591, 592, 40/605, 610, 571; 248/166, 165; 428/7, 428/8, 9

See application file for complete search history.

(56) References Cited

U.S. PATENT DOCUMENTS

| | | | | |
|---|---|---|---|---|
| 1,459,866 | A * | 6/1923 | Vest | 40/608 |
| 4,254,453 | A * | 3/1981 | Mouyard et al. | 362/240 |
| 4,259,660 | A * | 3/1981 | Oliver | 340/480 |
| 5,694,881 | A * | 12/1997 | Creech | 116/222 |
| 6,092,767 | A * | 7/2000 | Schrager | 248/98 |
| 6,148,551 | A * | 11/2000 | Glass | 40/214 |
| 6,323,832 | B1 * | 11/2001 | Nishizawa et al. | 345/83 |
| 6,334,687 | B1 * | 1/2002 | Chino et al. | 353/79 |
| 6,455,767 | B1 * | 9/2002 | Muller | 136/245 |

* cited by examiner

*Primary Examiner*—Sharon E. Payne
(74) *Attorney, Agent, or Firm*—Daniel P. Dooley; Fellers, Snider, et al.

(57) ABSTRACT

An illuminated sign includes a plurality of sections. Each section includes a mesh of conductors having illuminating pixels located at conductor intersections. The mesh is surrounded by a frame connected to the frame of another section. Once frame sections of the display are unfolded, the display can be supported by a structure attached to a car or other vehicle. A support structure for an illuminated display includes a base which is placed on the ground and over which the tire of a vehicle (e.g., a police car) is parked. A column extends from the base, and a display can be attached to the top of that extending column. The support structure can take the form of a collapsible stand having a trunk which is pivotally attached to a base and which contains a telescoping section.

33 Claims, 41 Drawing Sheets

RAPID DISPATCH EMERGENCY SIGNS

CROSS-REFERENCE TO RELATED APPLICATIONS

This application is a continuation of U.S. Non-Provisional application Ser. No. 11/079,474, filed Mar. 15, 2005, titled "Rapid Dispatch Emergency Signs" which claims priority to U.S. Provisional Application Ser. No. 60/619,966, filed Oct. 20, 2004, titled "Improved Rapid Dispatch Emergency Signs" and claims priority to U.S. Provisional Application Ser. No. 60/552,714, filed Mar. 15, 2004, titled "Rapid Dispatch Emergency Signs."

FIELD OF THE INVENTION

The invention generally relates to illuminated signs which can be rapidly deployed in response to relatively quickly changing conditions and used for, e.g., traffic control. The invention further relates to structures which can be used to support such signs.

BACKGROUND OF THE INVENTION

A variety of roadway or emergency situations have occurred over recent years that underscore the need for Rapid Dispatch Emergency Signs (RDES) or Rapid Dispatch Incident Management Signs (RDIMS) that get highly visible messaging to critical places quickly. Examples of such situations include traffic problems and road construction, as well as much more serious occurrences (e.g., the terrorist attacks of Sep. 11, 2001, the New York blackout, the Southern California fires, etc.). In all of these situations, authorities need to advise large groups of people where to go, what to do, etc. An illuminated sign or other display is often an ideal way to provide such information. If authorities can quickly move a portable illuminated display to where it is needed, hazardous or potentially hazardous situations can be better addressed.

Unfortunately, current incandescent and LED sign architectures are big, bulky and heavy. They are not easy to transport. Frequently, such signs must be transported on the back of specially designed trucks or towed by heavy, specially powered and designed trailer rigs. They are expensive and are often too far from the emergency situation to impact the flow of traffic or inform pedestrians and motorists about pertinent developments. If illuminated displays were less expensive and more easily transported, more such displays could be made available and/or located where they might be put to best use.

SUMMARY OF THE INVENTION

Embodiments of the invention address these and other challenges. In at least some embodiments, an illuminated display is readily collapsible into a more compact form for stowage and transport. This allows, for example, stowage of such a display in the trunk of a police car or in another location where the display will be readily available when needed. In at least some embodiments, a display includes a plurality of sections which can be folded. Each section includes a relatively lightweight mesh of conductors having illuminating pixels (e.g., one or more light emitting diodes) located at conductor intersections. The mesh is surrounded by a frame which can be connected to the frame of another section with a hinge, or in some other manner. Once frame sections of the display are unfolded, the display can be mounted on a support structure attached to (or stabilized by) a car or other vehicle.

Embodiments of the invention also include a support structure for an illuminated display. In at least some embodiments, the support structure includes a base which is placed on the ground and over which the tire of a vehicle (e.g., a police car) is parked. A column or other member extends from the base, and a display can then be attached to the top of that extending column. In certain embodiments, the support structure is a collapsible stand, and the column includes a trunk which is pivotally attached to the base and contains a telescoping section.

Additional features and advantages of various embodiments are further described below.

BRIEF DESCRIPTION OF THE DRAWINGS

The foregoing summary of the invention, as well as the following detailed description of preferred embodiments, is better understood when read in conjunction with the accompanying drawings, which are included by way of example, and not by way of limitation with regard to the claimed invention.

DETAILED DESCRIPTION OF THE PREFERRED EMBODIMENTS

Collapsible Displays

At least one embodiment of the invention utilizes a light weight mesh of electrically independent LED (light emitting diode) modules, such as a 3' by 5' full LED sign that can be collapsed into a package small enough to be placed in the trunk of any standard car. The collapsible LED display/sign can be made as a collection of multiple hinged panels. Alternatively, the collapsible sign can be formed as a flexible, continuous roll-out sign. The sign can be mounted on, e.g., a telescoping support structure. How one or more sign panels are connected (e.g. hinged vs. roll-out) is distinct from how a support structure deploys (e.g. telescoping).

An LED sign according to various embodiments of the invention can be constructed using any of the various methods, structures, and materials described in U.S. patent application Ser. No. 10/625,185 (filed Jul. 23, 2003 and titled "Electronic Assembly/System With Reduced Cost, Mass, and Volume and Increased Efficiency and Power Density," published on Jul. 1, 2004 as U.S. patent publication number 20040125515, hereinafter referred to as "the '185 application"), and any combinations thereof. The '185 application is hereby incorporated by reference herein. The methods, structures, and materials described in the '185 application generally provide a lightweight mesh-type structure that can be used to provide an LED sign suitable for carrying out the inventive principles herein.

Signs according to various embodiments of the invention can be used by, e.g., law enforcement agencies and emergency management service departments around the country. Embodiments of the invention can be deployed widely and strategically in the case of major emergency, as well as quickly and accurately when faced with interruptions to standard traffic flow. The existence of these signs in multiple vehicles as standard equipment greatly increases the chance that motorists and/or pedestrians can be quickly routed as appropriate.

In at least one embodiment signs can be powered from a standard cigarette lighter using appropriate power conditioning into the sign unit(s). In one variation, pixel output provides 40 candela with a 30 degree viewing angle.

Figure 1:
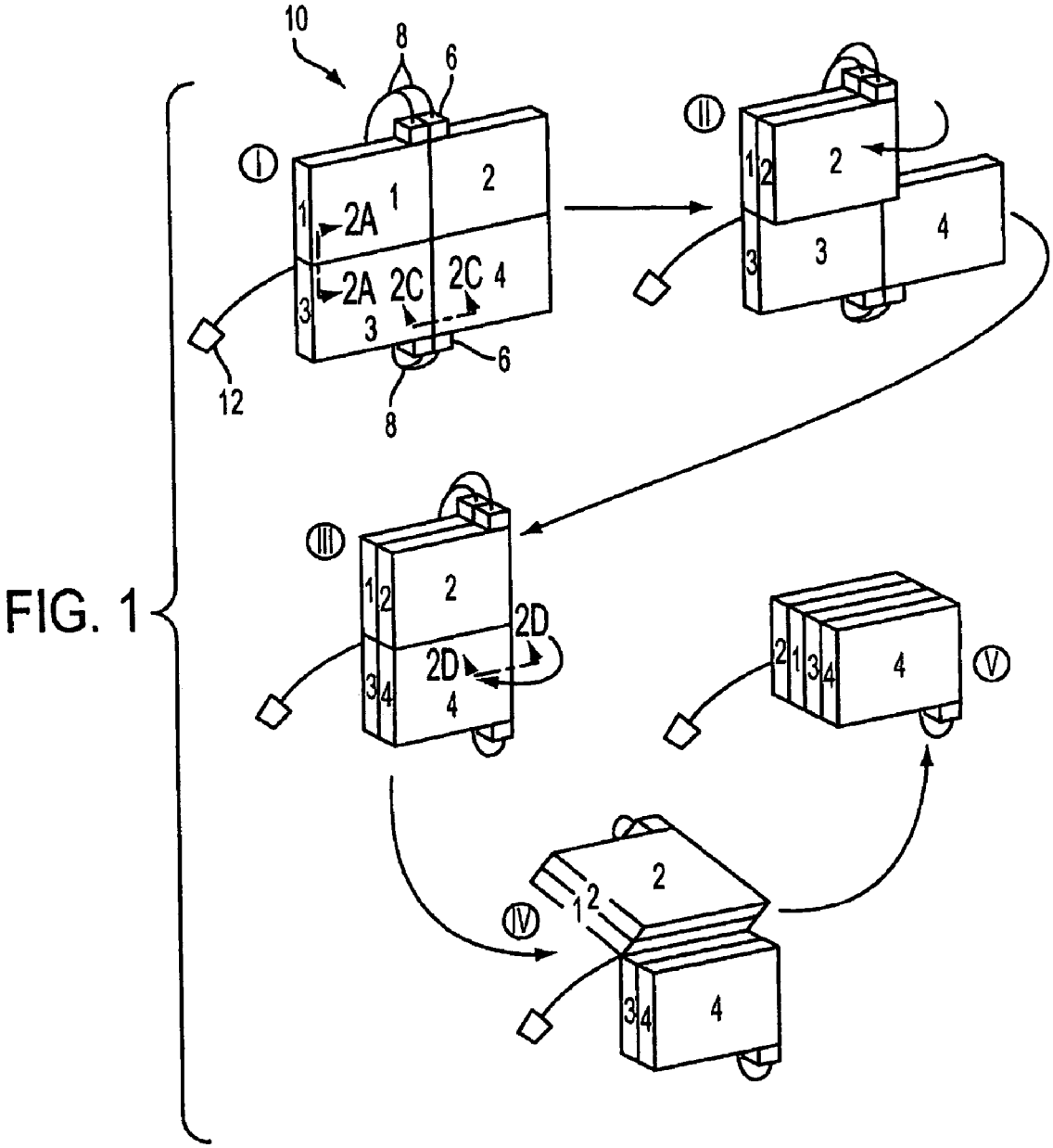
FIG. 1 shows an embodiment of a collapsible sign according to various embodiments of the invention.

FIG. 1 shows one version of a collapsible sign 10 according to various embodiments of the invention. As shown in FIG. 1, sign 10 includes modular sections 1, 2, 3 and 4. As shown in steps I through V of FIG. 1, sections 1-4 can be folded and collapsed for, e.g., storage. Step I shows sign 10 in an unfolded configuration. In step II, section 2 is folded against section 1. In step III, section 4 is folded against section 3. In step IV, section 1 is folded against section 3. Step V shows sign 10 in a fully folded configuration. The four discrete sign sections 1-4 each comprises an LED sign of the type shown in the '185 application or as described below. Sections 1-4 are hinged or otherwise joined in such a way that they can be collapsed as shown in FIG. 1. Electrical connectors 6 and/or cabling 8 can be used to connect the individual sections. Cabling 8 may also terminate in one or more plugs 12 by which power and control information is provided to sign 10. Strain-relieved cables (e.g., cables connecting sign sections with strain-relief fittings between the cables and sign frames) could also be used to connect sign sections. Ribbon cables or other electrical connectors may be connected along the edge of each section as appropriate to provide power and signaling to each LED sign section.

It will be understood that more or fewer sections may be provided as needed based on various considerations such as the size of the required sign, connectors, and other factors. Each sign section may comprise a rigid frame (e.g., aluminum) to which the LED mesh structure is mounted. The frames may comprise hinges or other joining mechanisms at the edges in order to fold or collapse a sign as shown in FIG. 1. Alternatively, the panels may be folded using an accordion-style folding format (not shown in FIG. 1).

Figure 2A:
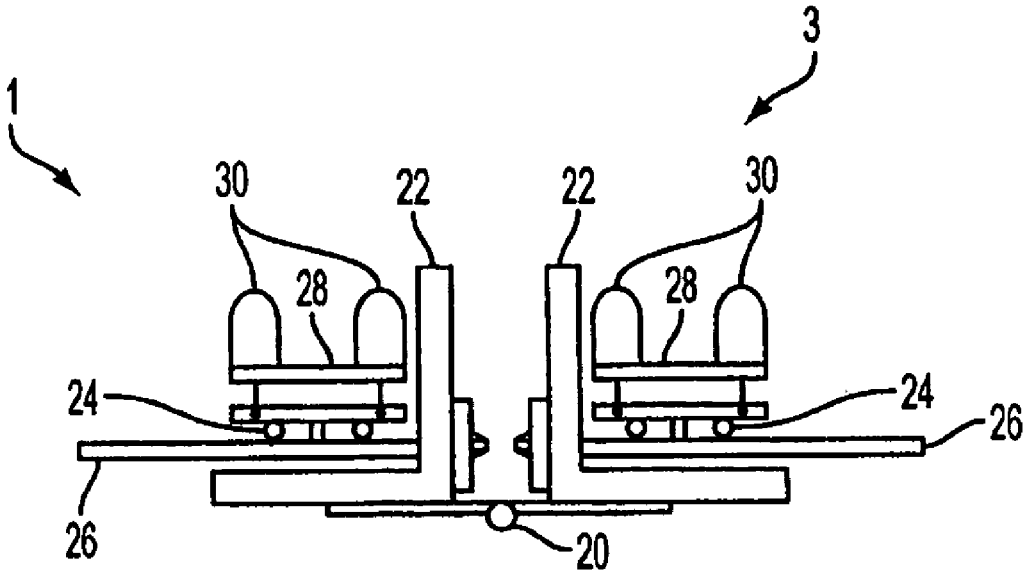
FIGS. 2A to 2D show one possible arrangement of hinges that can be employed to provide a folding sign structure of the type depicted in FIG. 1.

FIGS. 2A to 2D show one possible arrangement of hinges that can be employed to provide a folding LED sign structure of the type depicted in FIG. 1. FIG. 2A shows portions of two unfolded sign sections joined by a hinge 20. In particular, FIG. 2A shows a partial cross section of sign 10 at the adjoining edges of sections 1 and 3. An approximate location of this cross section is indicated in FIG. 1 at step I. Each section of sections 1 and 3 includes a frame 22 that can support a mesh of wires of the type described in the '185 application. Instead of a one-by-one mesh arrangement, however, FIGS. 2A-2D show a two-by-two mesh arrangement of the type described in more detail below in connection with FIGS. 3 and 4. In other words, and as shown in FIG. 2A, a pair of X-directional wires 24 cross a pair of Y-directional wires 26 at the edge of each of sections 1 and 3, and a small (e.g., ¾ inch by ¾ inch) circuit board 28 is affixed to each four-wire junction. Four LEDs 30 are affixed to each circuit board 28, and each circuit board may be spaced apart by 1½ inches, for example. The circuit boards are joined to the mesh wires by electrical connections. Each of sections 1-4 includes multiple circuit boards, LEDs and wires of the type shown in FIG. 2A.

Figure 2B:
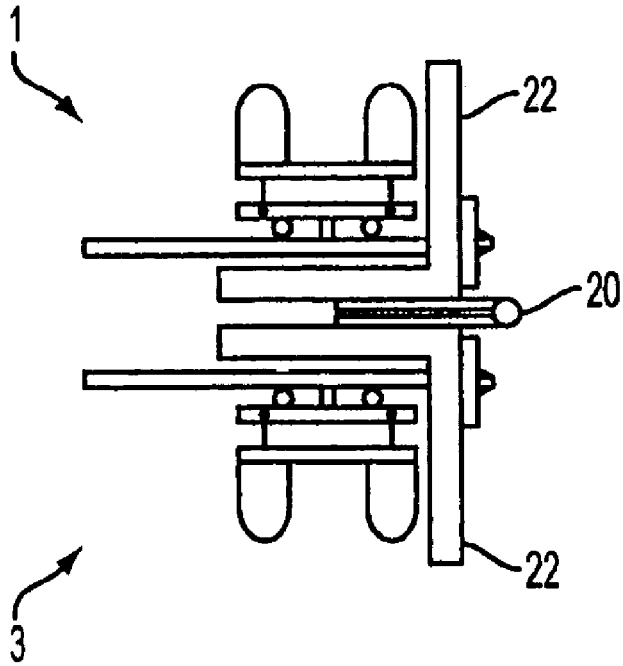

FIG. 2B shows the cross-section of FIG. 2A in a folded position. In other words, FIG. 2B shows a partial cross section of sign 10 at the adjoining edges of sections 1 and 3 after those sections have been folded over against one another (FIG. 1, step V).

Figure 2C:
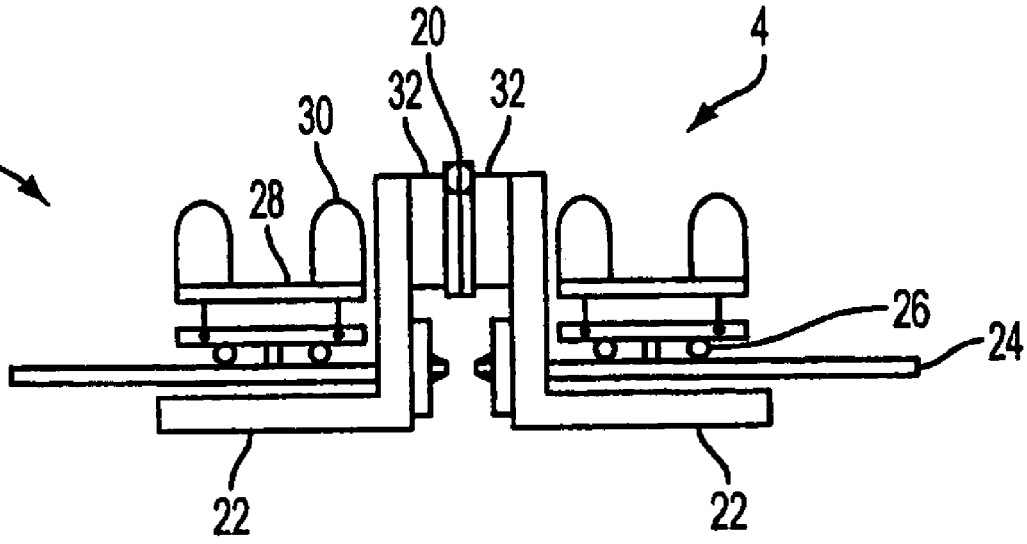
Figure 2D:
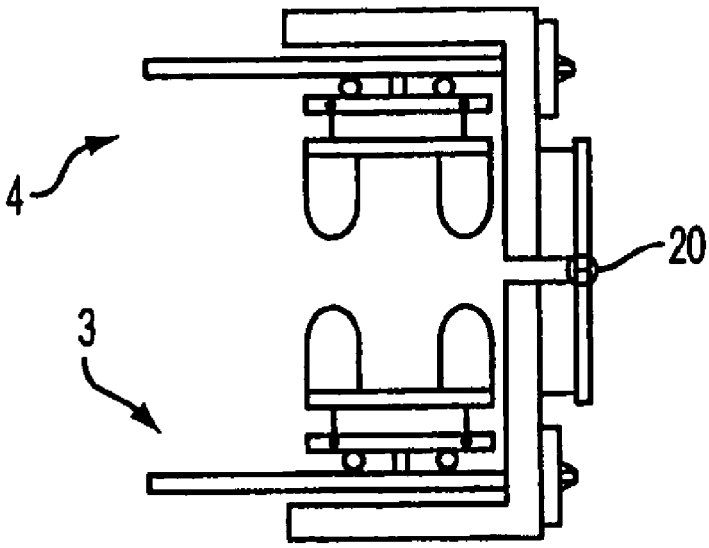

FIGS. 2C and 2D show partial cross-sections respectively corresponding to unfolded and folded sections 3 and 4. In particular, FIG. 2C shows a partial cross section of sign 10 at the adjoining edges of sections 3 and 4. An approximate location of this cross section is also indicated in FIG. 1 at step I. FIG. 2C is generally similar to FIG. 2A, except that hinge 20 has been moved to the distal ends of the webs of frames 22. Hinge 20 is also attached to frames 22 using two spacers 32. In this manner, and as shown in FIG. 2D, sections 3 and 4 fold against each other. An approximate location of the partial cross section of FIG. 2D is indicated in FIG. 1 at step III.

Figure 3:
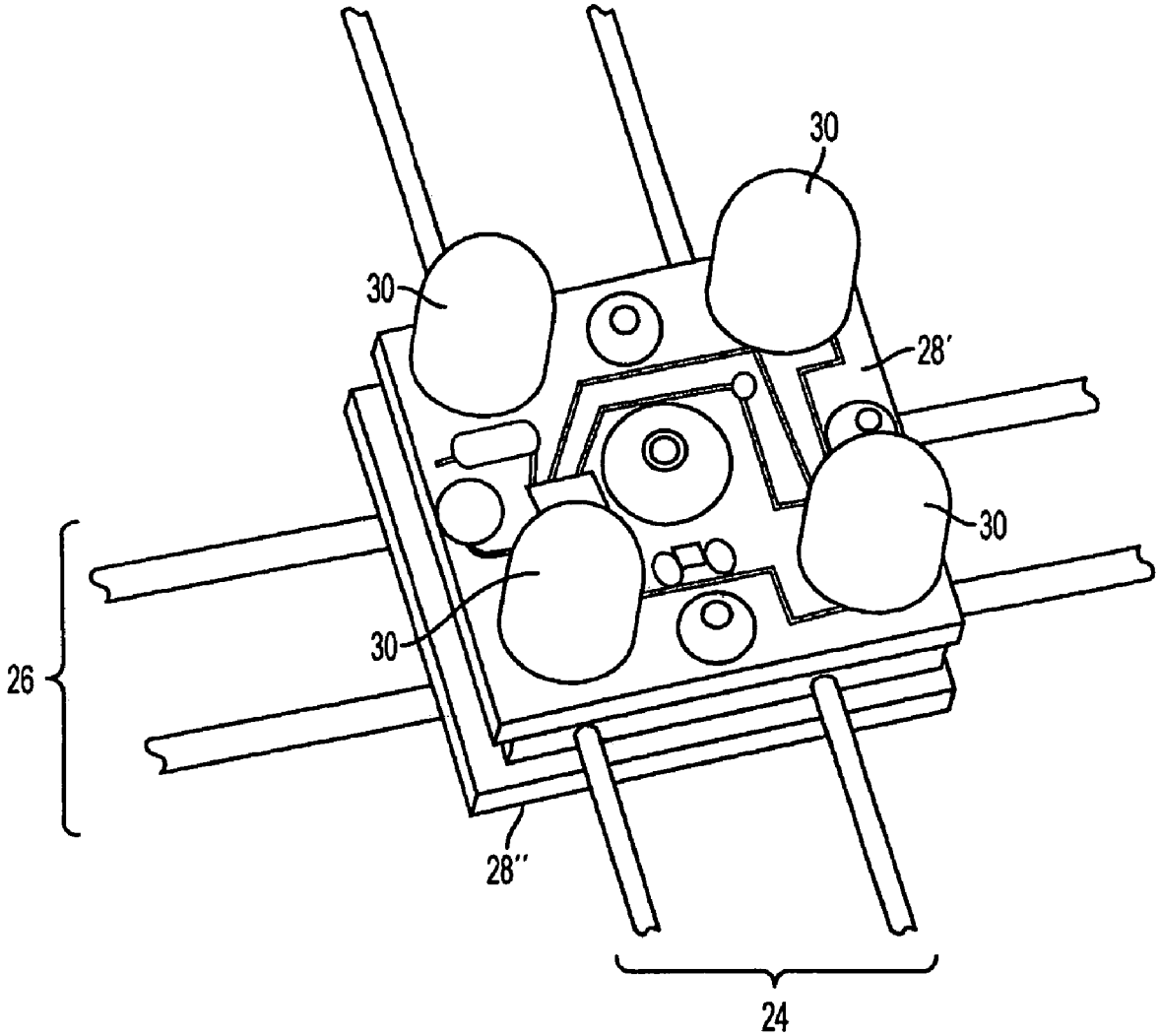
FIG. 3 shows one possible LED arrangement.
Figure 4:
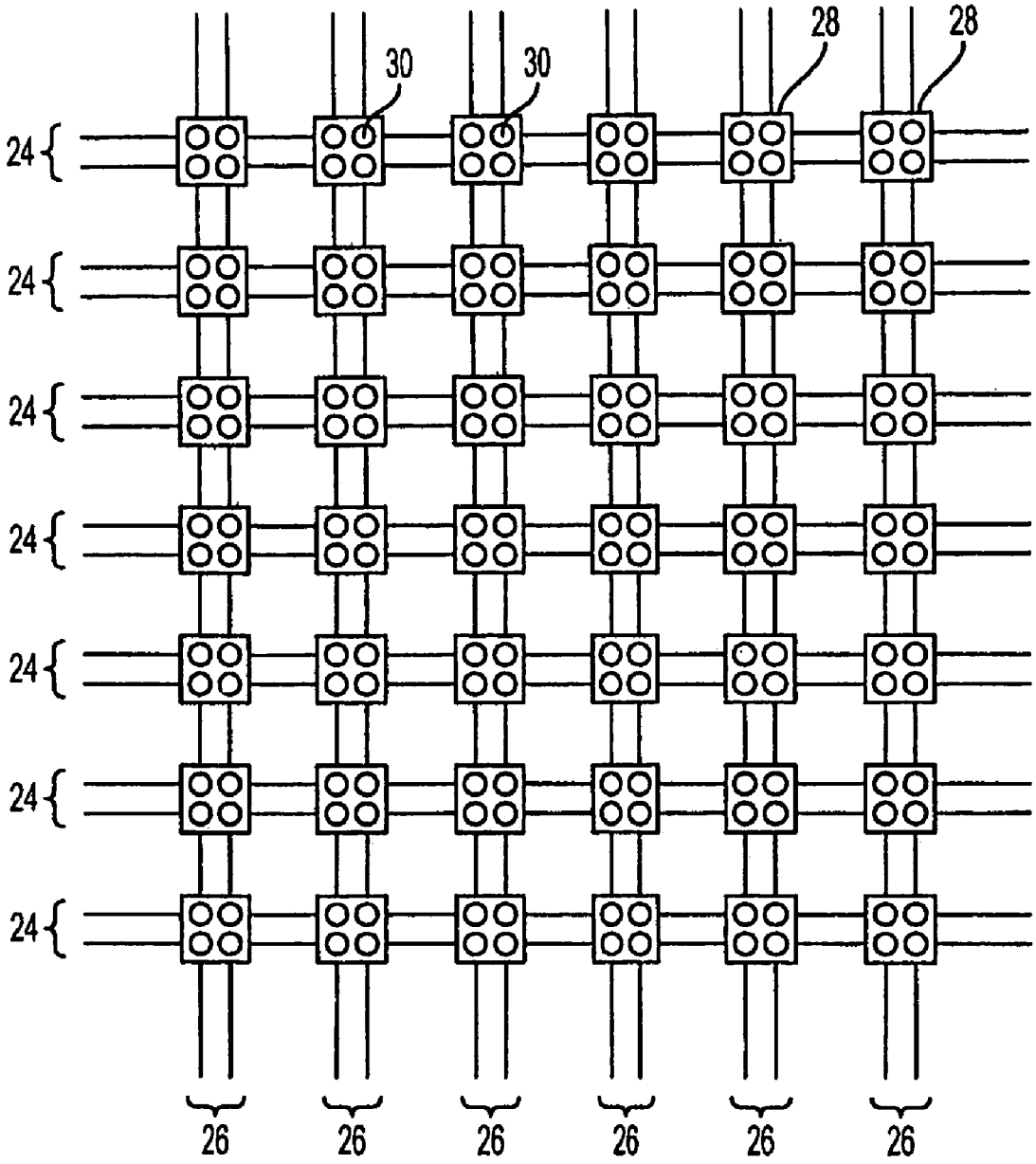
FIG. 4 shows a mesh of the type using the PCB-mounted LEDS of FIG. 3.

FIG. 3 shows one possible LED arrangement for use in the foldable panels of FIGS. 1 and 2A-2D. In particular, FIG. 3 shows a circuit board 28, LEDS 30, a pair of X-directional wires 24 and a pair of Y-directional wires 26 similar to those shown in cross section in FIGS. 2A-2D. At each junction of X- and Y-directional wire pairs 24 and 26 within each of sections 1-4 of FIG. 1, a small printed circuit board (PCB) 28' having 4 LEDs 30 is affixed to the mesh. The PCB 28' is arranged such that it and another PCB 28" sandwich one set of wires and the other set of wires is fixed to the back of the PCB 28" (as shown in FIG. 3). Other configurations are possible. FIG. 4 shows a mesh of the type using the PCB-mounted LEDS of FIG. 3, which can be employed in the foldable panels of FIGS. 1-2D.

Once unfolded, a sign can be plugged into a power generator. A standard character generating driver enables the easy input of specific messages. The sign can be mounted in various locations on, near, or abutting a vehicle, such as a squad car.

Figure 5:
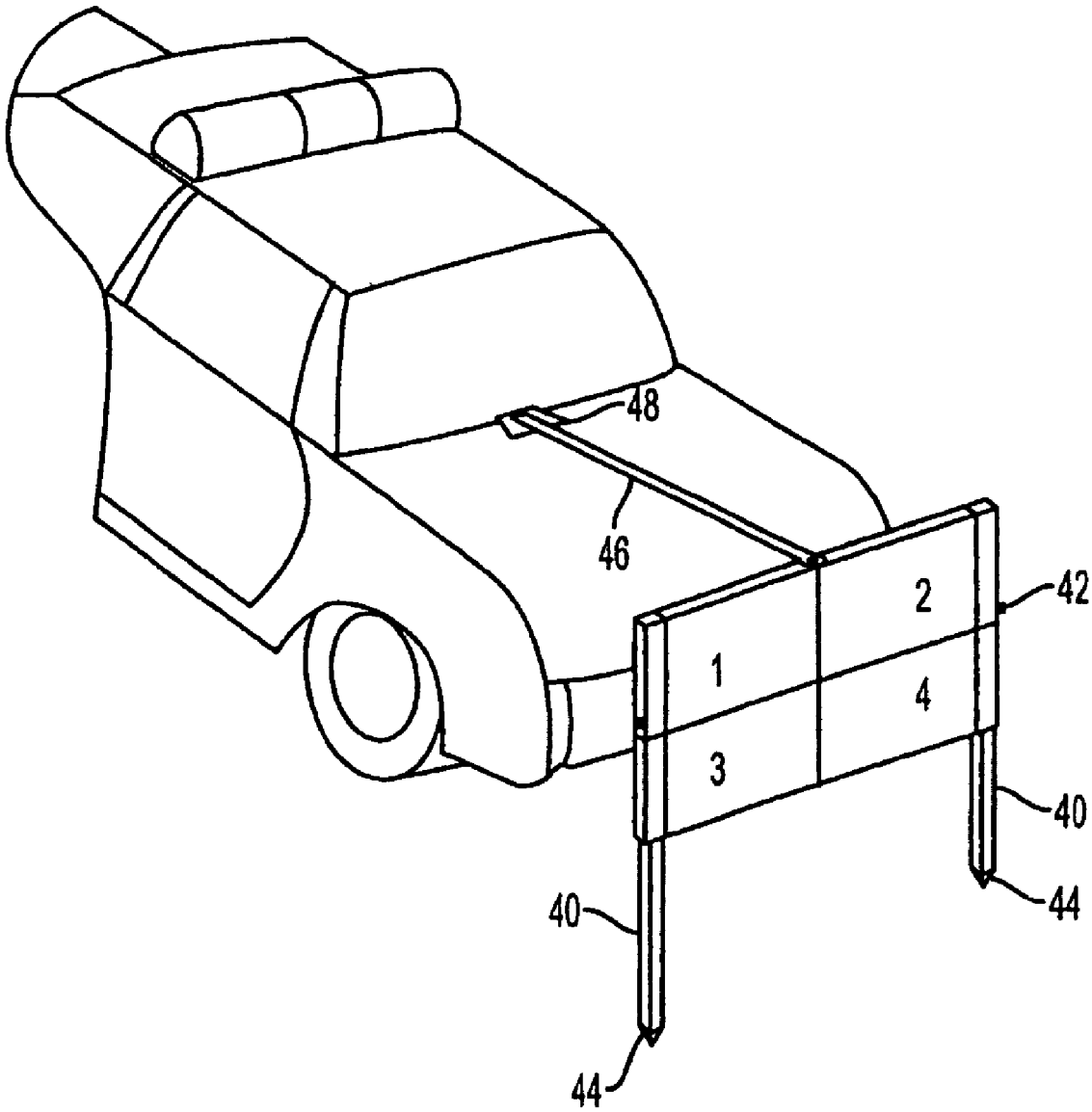
FIG. 5 shows an embodiment in which foldable sign sections are attached to legs having a telescoping height adjustment.

Telescoping brackets can be used to raise the sign to the standard height required for vehicle mounted incidence management signs. FIG. 5 shows an embodiment in which foldable sign sections 1 through 4 are attached to legs 40 having a telescoping height adjustment 42. Legs 40 may have points or spikes 44 at their ends. An optional tie bar 46 and anchor point 48 can be used to stabilize and orient the sign sections 1-4 with respect to a police car or other vehicle.

In one embodiment, the sign can be stored in a compartment, such as a trunk, cargo bed, or back seat, then removed from storage and set up. In another embodiment, the sign can be deployed in place (e.g., from a roof rack, etc.). In yet another embodiment, the sign can be towed as a separate trailer. In all cases, the stowed form factor is much smaller than the deployed form factor.

Figure 6:
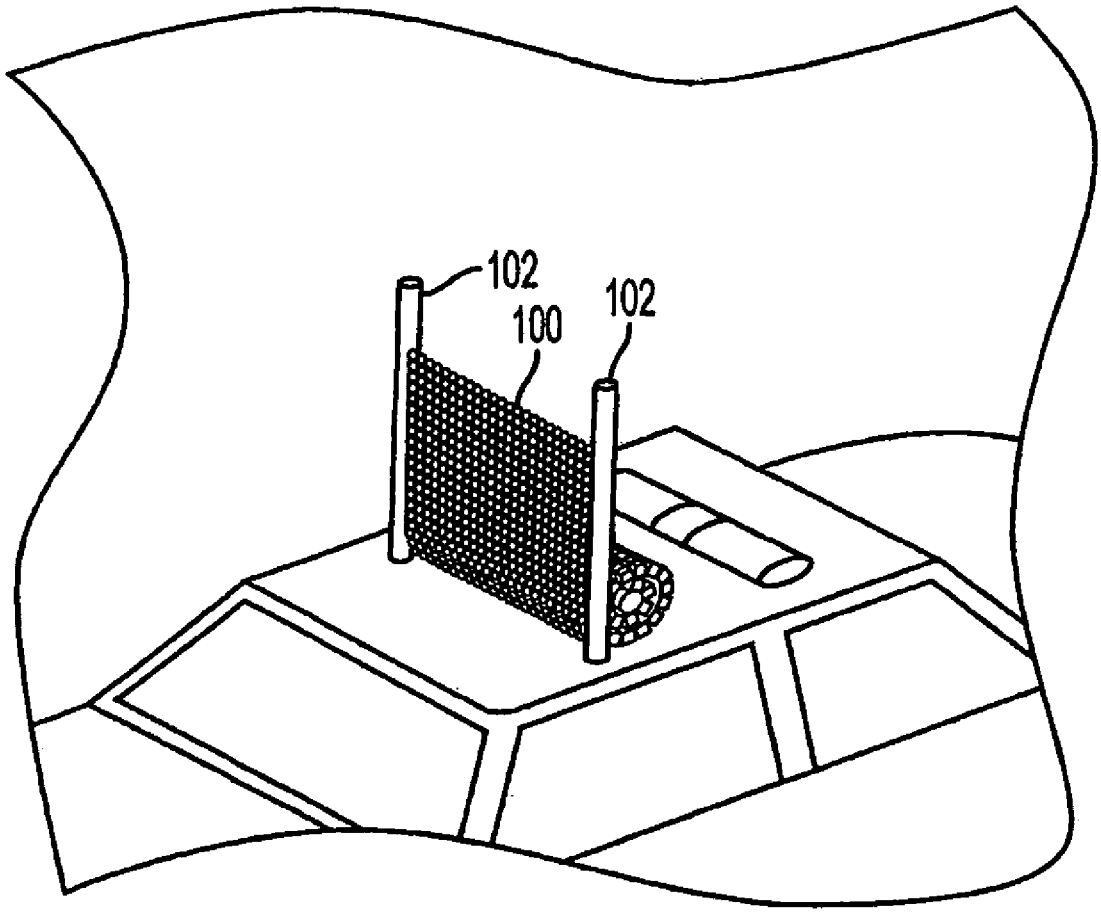
FIG. 6 shows an embodiment in which a mesh-type sign is unrolled and raised into a holding bracket.

At least some embodiments of the invention provide for a rollable mesh-type sign that can be rolled up and stored when not in use. FIG. 6 shows one possible scheme in which a mesh-type sign 100 is rolled up and can be raised into one or more holding brackets 102 for use. The signs can be mounted on a roof rack. In one embodiment, they can be integrated into a rack on the roof of a vehicle. Alternatively, they can be rolled up into a cylinder. Due to the flexible nature of the LED signs, a mechanical apparatus can be attached to the top of a delivery vehicle, such as a squad car. In one embodiment, the sign is contained in a cylinder that can be raised from a laying down position to an upright and vertical position, then rolled out to its full length and illuminated as appropriate through the vehicle's own power.

In one embodiment, the mesh signs have the ability to deform into a cylinder for storage and future deployment. A mesh of lighter wire could be used to resist persistent deformation. The cylinder can be turned sideways, with the structure of the cylinder providing the vertical support; or it can remain horizontal, with telescoping vertical supports on each end being extended to provide support.

One embodiment emulates rolling up continuously, but instead folding at pixel boundary points (every 1"-1.5") at an angle less than 45%, with the module frame having links or hinges at matching points. This accomplishes the same goal as rolling up for the stowage and deployment mechanism, but at a scale larger than the size of individual electronic components and the mini-PCB boards for the pixels and control electronics.

Yet another embodiment is similar to metal gratings used to protect glass storefronts when they are closed, and which roll into cylindrical forms above storefront windows and below awnings. The same concept applies in this embodiment, except the "rolling" happens at articulation points between the pixels, so that electronic components and LEDs are not crushed. Similarly, the semi-rigid frame that surrounds the modules and which holds the wire mesh in place (as well as containing additional control electronics) rolls in the same manner.

Several methods are possible for deploying the sign from its stowed state, including unrolling (or unhinging) and attachment to a telescoping support stand. At deployment, the sign can be affixed to the vehicle, such as a roof rack, mounted on the trunk, or stuck in the ground and attached to a trunk. Various types of deployable structures that can be used are described in Sergio Pellegrino, ed., 2001, Deployable Structures, Vienna: Springer-Verlag (incorporated by reference herein), which summarizes structures that start out in one compact form and extend to a larger form having the requisite strength.

To minimize set up time for rapid dispatch, several forms of interconnection are possible, including power, signal (including wireless), and mechanical. For example, the sign can be integrated with a cruiser's onboard computer and communications; text for messages can be entered using existing data entry equipment, or text can be updated from headquarters using existing radio/data interface. Sound can be synchronized with the display to reinforce or supplement the text messages, and routed through existing external speakers. Power can be drawn from existing power bus on the vehicle (presumably 42V), or through a cigarette lighter-style connection.

A towed version of the sign is also possible. Due to the light weight and easy transportability of the signs, a towed trailer can carry nested emergency signs that can be easily deployed along a route, powered by solar and updated remotely (e.g., each sign having a specific unique IP address to which programming messages and display content can be sent).

For routine roadwork, or situations where a variety of motorists need to be informed of an emergency that affects multiple exits and/or intersections, the nested towed signs would require only a single vehicle to deliver multiple signs along a route or group of routes. The nested signs can be loaded on one delivery vehicle that is equipped with all necessary attachments and power delivery equipment. In one variant, because of the greater thickness at the base of the sign (for balance and for batteries), the stacking of the nested signs could be at an angle. A standard turn-up method of procedure (MOP) would bring the sign on-line for immediate control from either a remote or central location.

Figure 7:
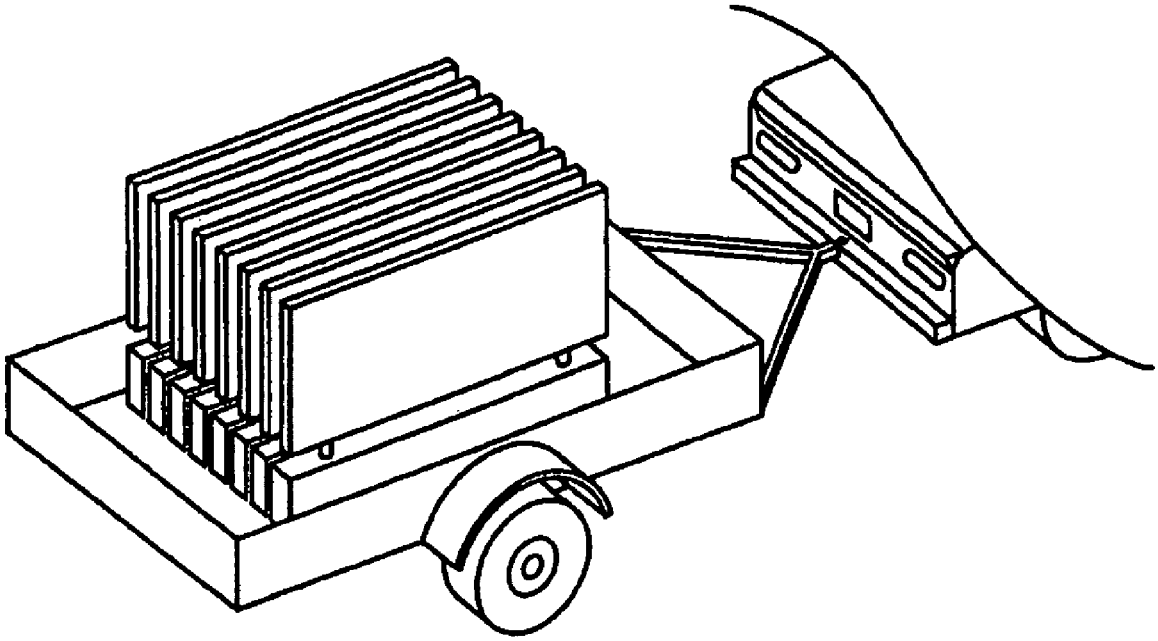
FIG. 7 shows a collection of signs on a trailer.
Figure 8:
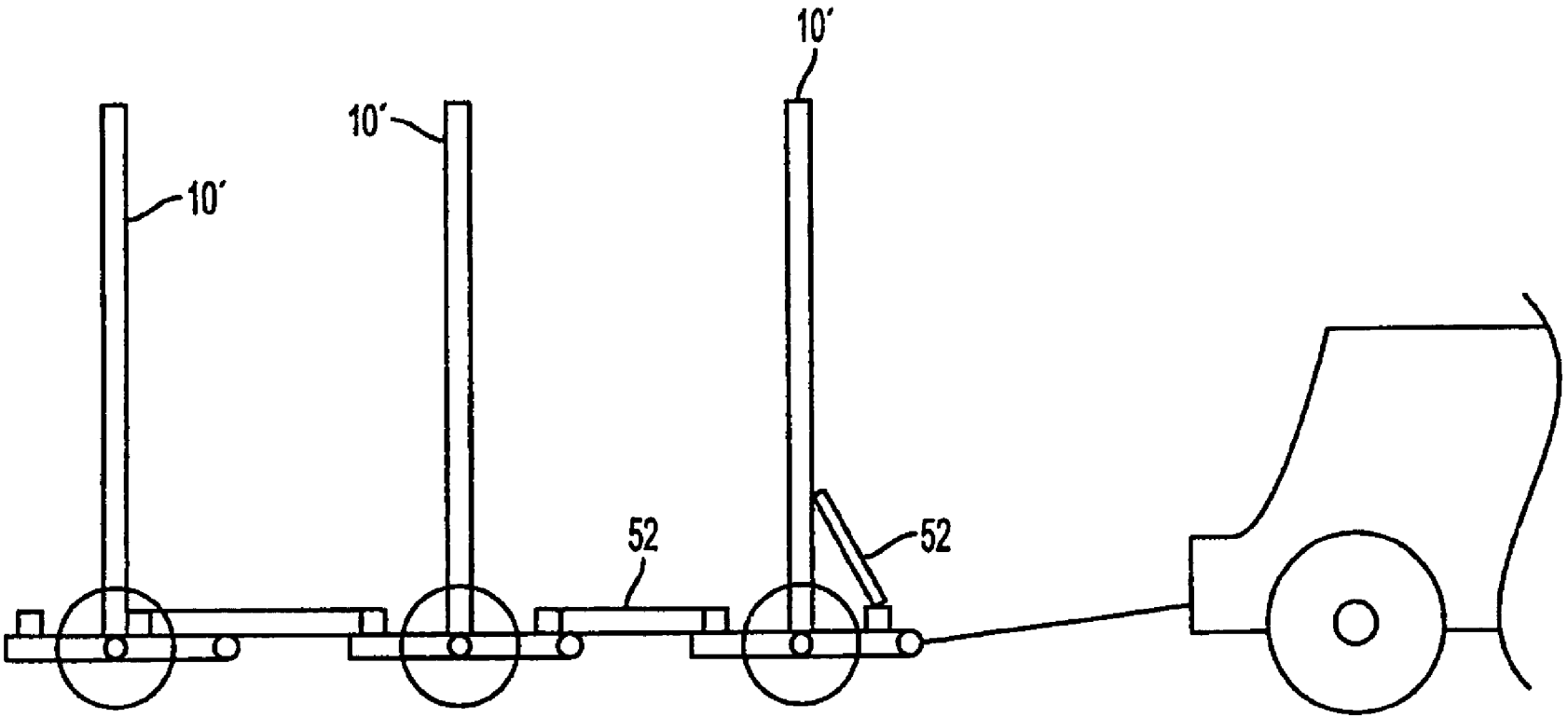
FIG. 8 shows multiple signs with wheels and which are linked together.

For stowage, each separate drop-off sign can be nested, so that the area taken up by each additional sign only adds a small percentage to the overall size of the stack (see FIG. 7). All components, not just the sign, can be designed to be lightweight and having low wind loading. As a result, the configuration can require much less weight to counterbalance (e.g., sandbags). FIG. 8 shows an alternative embodiment, wherein multiple signs 10' each with wheels are linked together (similarly to how shopping carts are joined) and towed by a vehicle. A linking element 52 (e.g., a metal latch or bar) can double as a stabilizing stand to keep a sign upright after it is deployed. This configuration permits rapid deployment without the need for moving heavy equipment, yet permitting several signs to be simultaneously towed.

In one embodiment, the signs are self-powered (e.g., battery or solar).

Each sign can include wireless communication, plus GPS. From patrol cars or from a central control facility, a display map with locations and messages of all dropped-off signs can be provided.

Although the signs have many intended and possible applications, at least one application involves diverting traffic from accidents or other areas using rapid dispatch high visibility signs. For example, according to one method, the invention includes steps of: (1) unrolling a rolled-up wire mesh comprising a plurality of individually addressable lighted elements; (2) programming the individually addressable lighted elements to display a traffic-related message; and (3) positioning the unrolled wire mesh in a line of vision to display the traffic-related message.

Other variants include unfolding rather than unrolling in step (1), and pre-programming the individually addressable lighted elements rather than performing step (2) at the traffic scene. Additionally, messages can be coordinated across multiple signs (towed, drop-off version or just multiple cruisers). Other methods include steps mentioned or suggested herein, which may be combined in various ways. This may include, for example, steps of unpacking folded sign portions, affixing signs to roof racks or trunks of vehicles, and stabilizing signs using various types of mounting mechanisms are also contemplated.

According to another aspect of the invention, the signs can be used for event management, e.g., 100,000 people at a stadium, setting up custom routes and instructions for parking and for exit, etc. This avoids the need to hire as many parking attendants, and avoids the need to wait while each driver rolls down window and hears instructions. It permits authorities or event staff to respond in real-time to bottlenecks to re-route waiting cars, and to display ads for future events.

According to yet another aspect of the invention, the signs can be used in a military setting, such as at military check-points, e.g., in Iraq or Afghanistan. They can be used as part of a rapid set-up, carried in a jeep or Humvee. They can be used to communicate with vehicles and foot/donkey traffic, in local languages. They can provide instructions on what will be checked by the soldiers staffing that site, on the purpose of the check-point, descriptions of persons about whom information is being collected, etc. This may be important because of language barriers. Frequently, soldiers deploying a sign or staffing a check-point may not know the local language (e.g., Arabic, Pashtun, etc.). However, LED-based displays can render any language or script. The signs can also be updated quickly and/or remotely. For example, a threat level could be raised, causing procedures to change. Instructions corresponding to the changed procedures can be instantaneously changed at every check-point simultaneously. If a new photo of the wanted terrorist becomes available, it can be displayed to everyone immediately.

Figure 9:
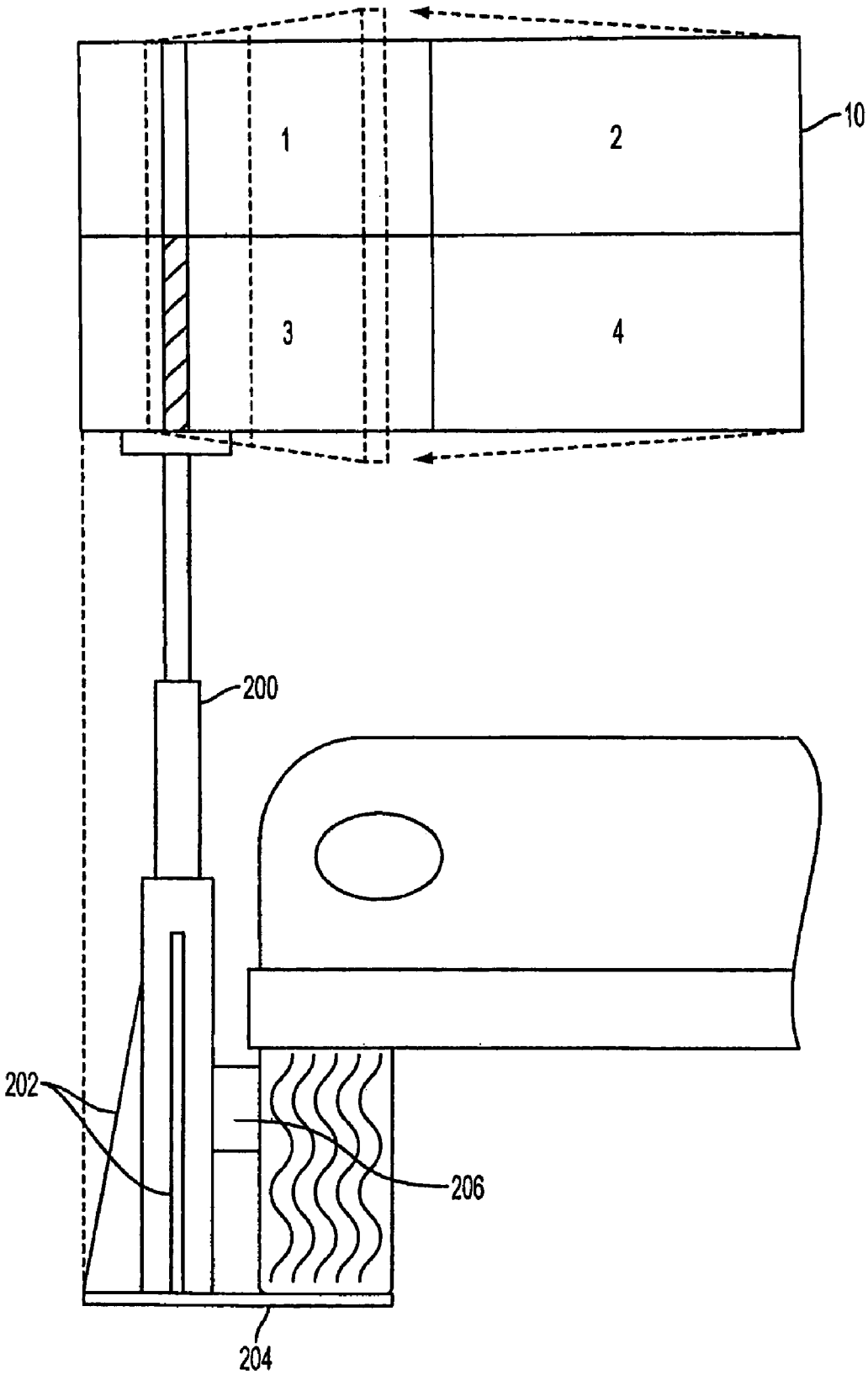
FIGS. 9-11 show sign embodiments which can be pole-mounted and stabilized with a vehicle.
Figure 10:
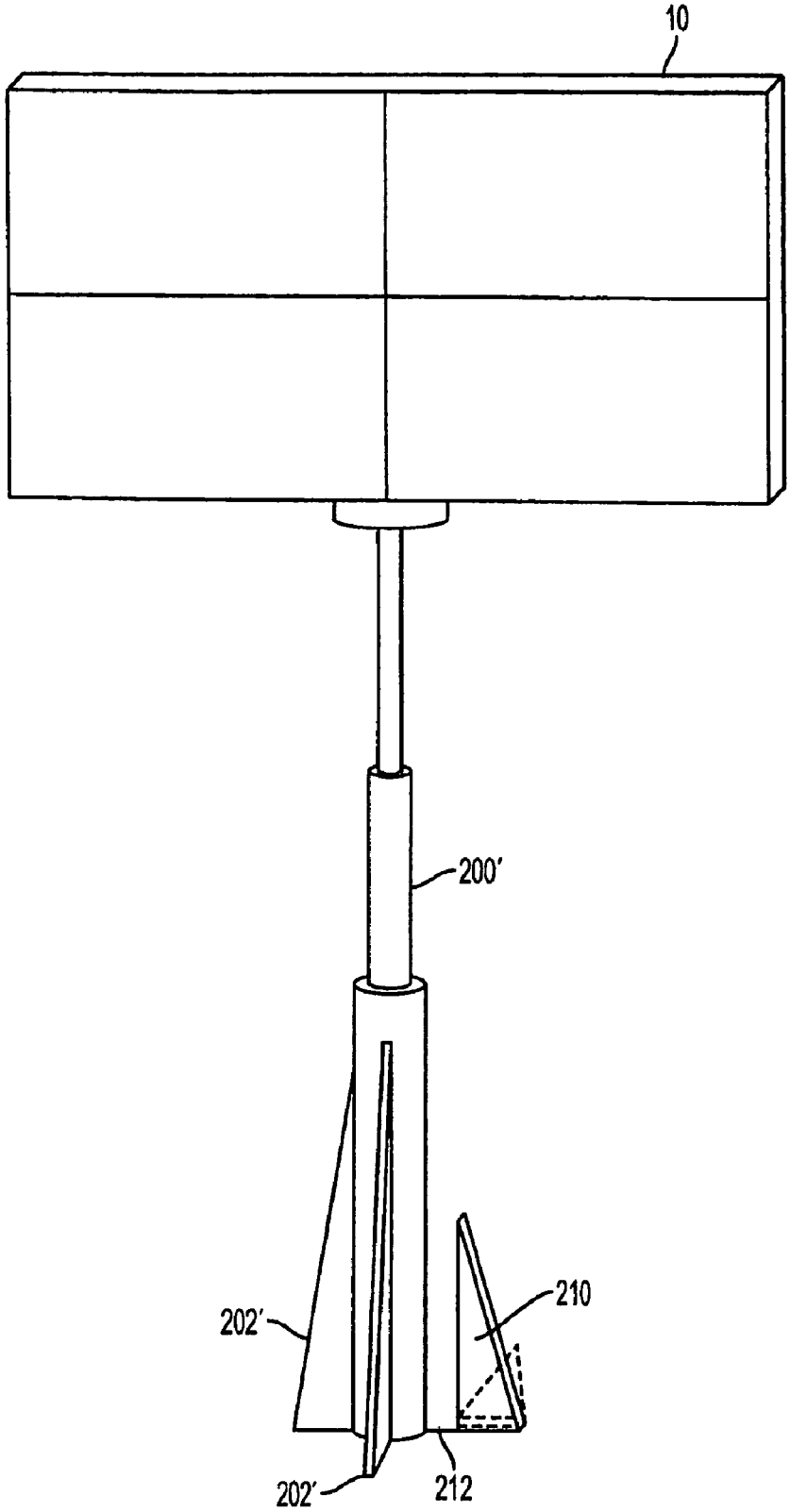
Figure 11:
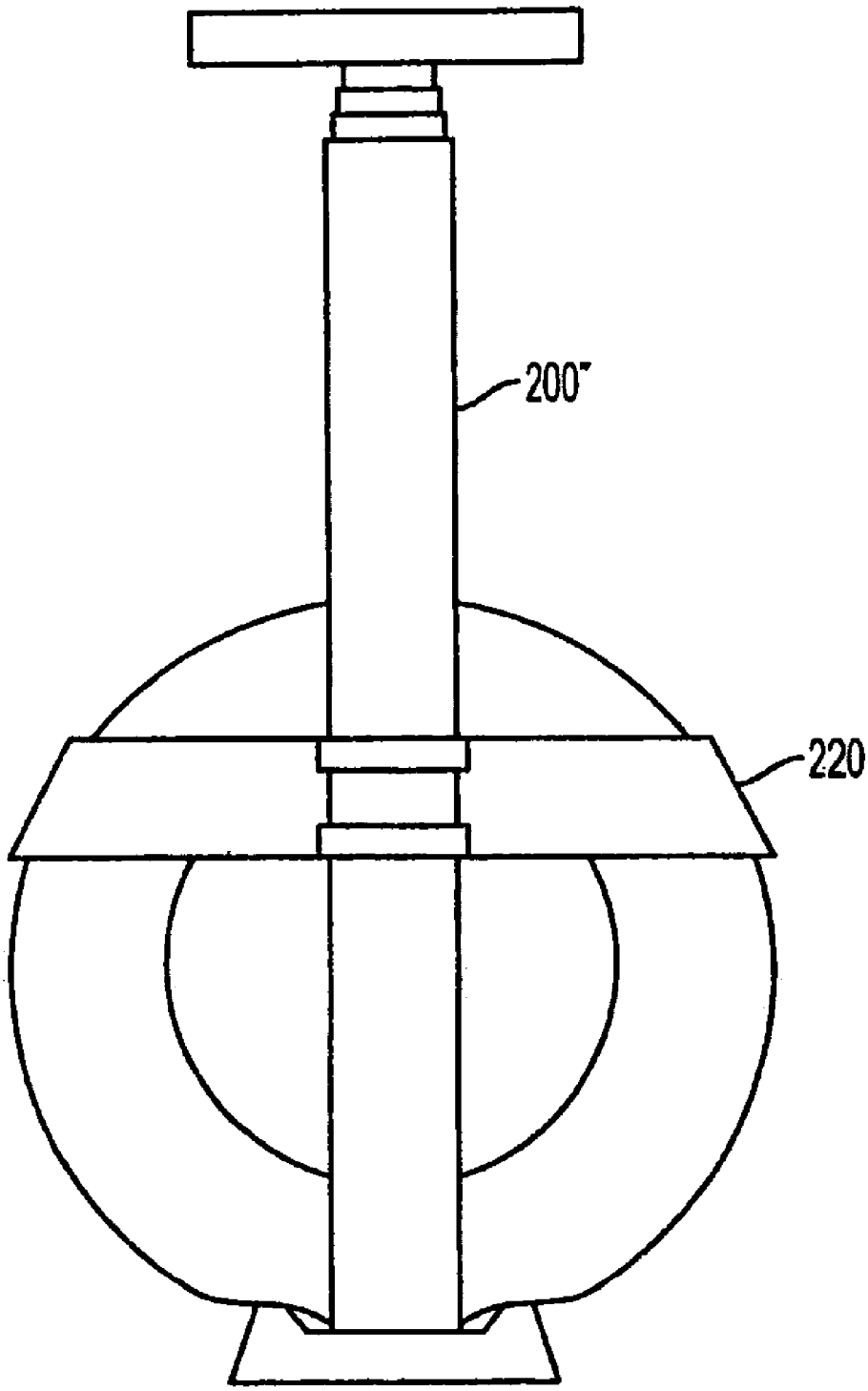

Signs according to at least some embodiments can be mounted to a pole-supported (e.g., columnar) structure and stabilized with a vehicle, as illustrated in FIGS. 9, 10, and 11. The panels can be folded and unfolded in any of various directions as dictated by the particular application. As seen in FIG. 9, for example, sections 1-4 of sign 10 can be rotated from a first position (shown in solid lines) to a second position (shown in broken lines). In FIG. 9, sign 10 is attached to a telescoping mounting pole (column) 200 stabilized at its base by fins 202. With fins 202, and with base plate 204 and/or attachment bracket 206, a pole on just one side (or vehicle tire) can be provided. Telescoping mounting pole 200 is embedded in the sign to provide rigid mounting support.

FIG. 10 shows a sign 10 attached to a telescoping mounting pole 200' having fins 202' which are no wider than the width of sign 10 (e.g., 3"). This fin width allows for easier storage. Fins 202' provide multi-directional support for the base of telescoping pole 200'. In particular, three fins 202' (separated by 90 degrees) and a fourth fin 210 on the tire side (described below) support pole 200'. The angle of sign 10 can be pivoted regardless of the orientation of car, with appropriate pivots and locks to rotate and then fix in place.

A tire mount is provided by fourth fin 210, which folds out to be flat on the ground. The operator then drives the vehicle over fourth fin 210 extending from the base of the pole, to provide additional stability (see FIG. 9), except the angle of the fin may be toward the tire, rather than parallel to it. For fourth fin 210, a lip 212 sticks out from base of the column the same distance that the other three fins extend. Fourth fin 210 is hinged at that point for laying fourth fin 212 flat (shown in broken lines). A vehicle tire is parked directly on top of the hinge, so it does not need to provide any structural support. Instead, the solid metal of the fin itself bears the stress.

Figure 12:
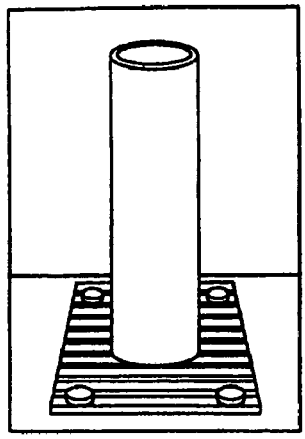
FIGS. 12-14 show various methods of mounting a sign-support pole.
Figure 13:
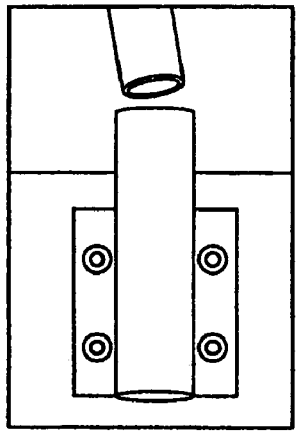
Figure 14:
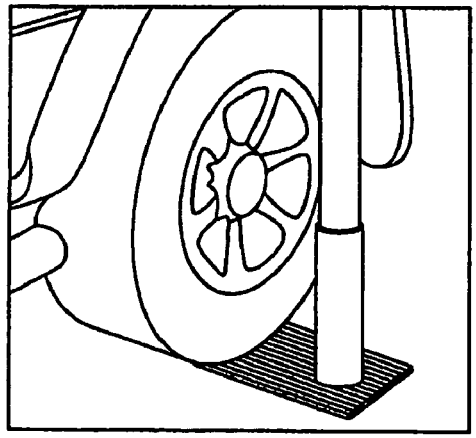

FIG. 11 shows an alternative embodiment of a telescoping pole 200" for supporting a sign (not shown). Pole 200" includes a clamp 220 on both sides of a tire. FIGS. 12-14 shows alternative mounting options. In FIG. 12, a cylindrical bracket (for holding a sign support pole, not shown) is attached to a mounting plate, which can in turn be bolted or otherwise attached to another surface. FIG. 13 is similar to FIG. 12, but shows a mounting plate attached to the side of a cylindrical bracket so that the cylindrical bracket can be mounted to a side edge of a surface. FIG. 14 shows a cylindrical bracket and mounting plate similar to that of FIG. 12, but which is instead stabilized by a vehicle tire instead of by attachment to another surface.

Figure 15:
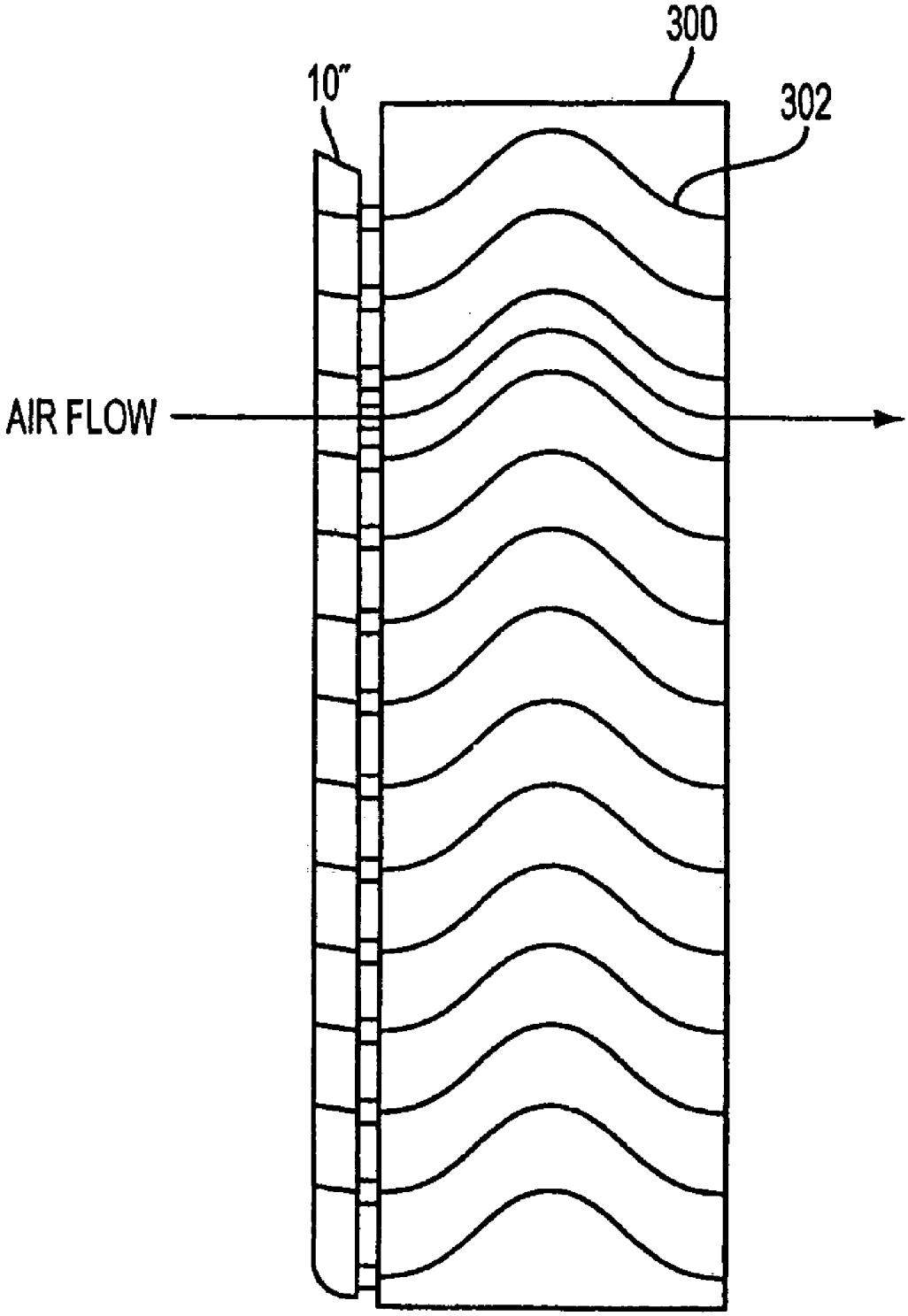
FIG. 15 shows at least one embodiment of a sign background.

In at least some embodiments, an aerodynamically-engineered contrasting background is provided to enhance viewing of a message displayed by a sign. FIG. 15 shows, in cross-section, a permanently installed aerodynamic wave shaped contrasting background 300 and sign 10". Contrasting background 300 is designed to be transparent to wind/airflow, but to be visually opaque. The contrasting background can be used for any application that requires reduced wind loading but high contrast background.

In at least some embodiments, a wave design is contemplated as shown in FIG. 15. A wave design requires no moving parts and is easy to implement. A mesh/grid of sign 10" is placed directly in front of the contrast screen of background 300, and can be attached using a frame with supports. The background material of background 300 may be a dark color (e.g., black) and may be coated or painted. The material may comprise a lightweight material such as plastic or aluminum and may be impervious to exposure to the outdoor environment. The aerodynamically curved slats 302 can be held in place by pins or other connecting elements to a frame that parallels and/or is connected to the frame for the LED mesh/grid of sign 10". The pins can hold slats 302 rigidly in place, or they may permit pivoting to accommodate wind loading. For transportation, it may also be possible to nest or collapse slats 302 (similar to Venetian blinds). Moreover, the structure may be disassembled for ease of transport. In certain embodiments, the wave background may comprise a single piece, but the LED sign may be folded in hinged portions and removed from the structure for compact storage.

Stowable Telescoping Stand

Figure 16:
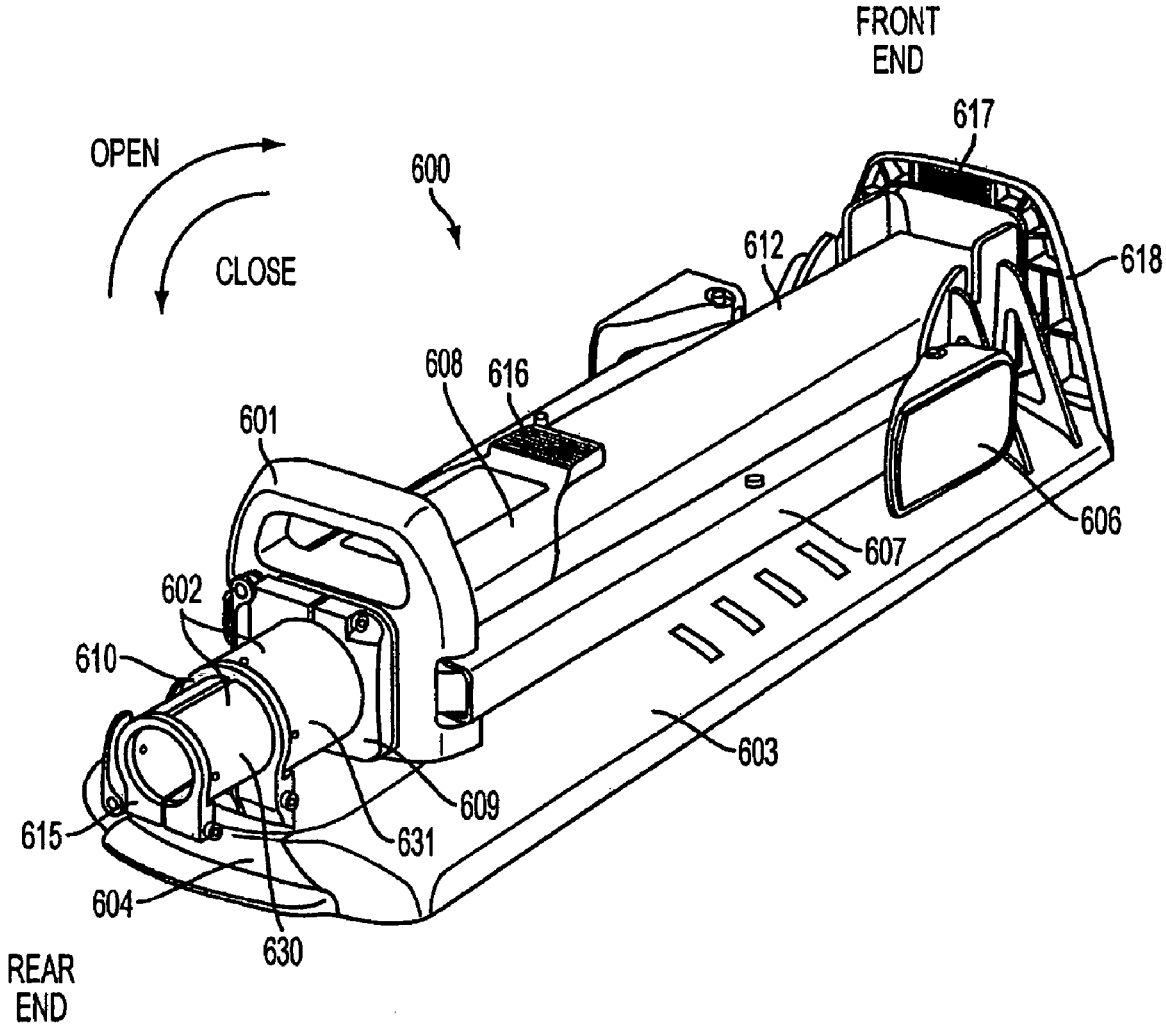
FIG. 16 is a rear end perspective view showing an embodiment of a stowable telescoping stand.

FIG. 16 is a rear end perspective view showing one variation of a stowable telescoping stand 600 that can be used to support a sign of the type described above. Stand 600 is rapidly deployable and includes a self-latching mechanism in both the closed (stowed) and open (deployed) positions. FIG. 16 shows stand 600 in the stowed configuration. Handle 601 is part of collar 608, and is formed to provide an easy gripping surface that permits a telescoping section 602 to be pulled from trunk 612 and locked into an upright position (as shown in subsequent drawing figures) so as to provide a column for mounting a sign. Telescoping section 602 includes an inner tube 630 and an outer tube 631. Base 603 includes a first latch 604. When depressed (by, e.g., an operator's foot), latch 604 releases trunk 612 and telescoping section 602, permitting telescoping section 602 to be moved to its upright position and extended. Various other elements of stand 600 indicated by reference numbers in FIG. 16 are described below.

Figure 17:
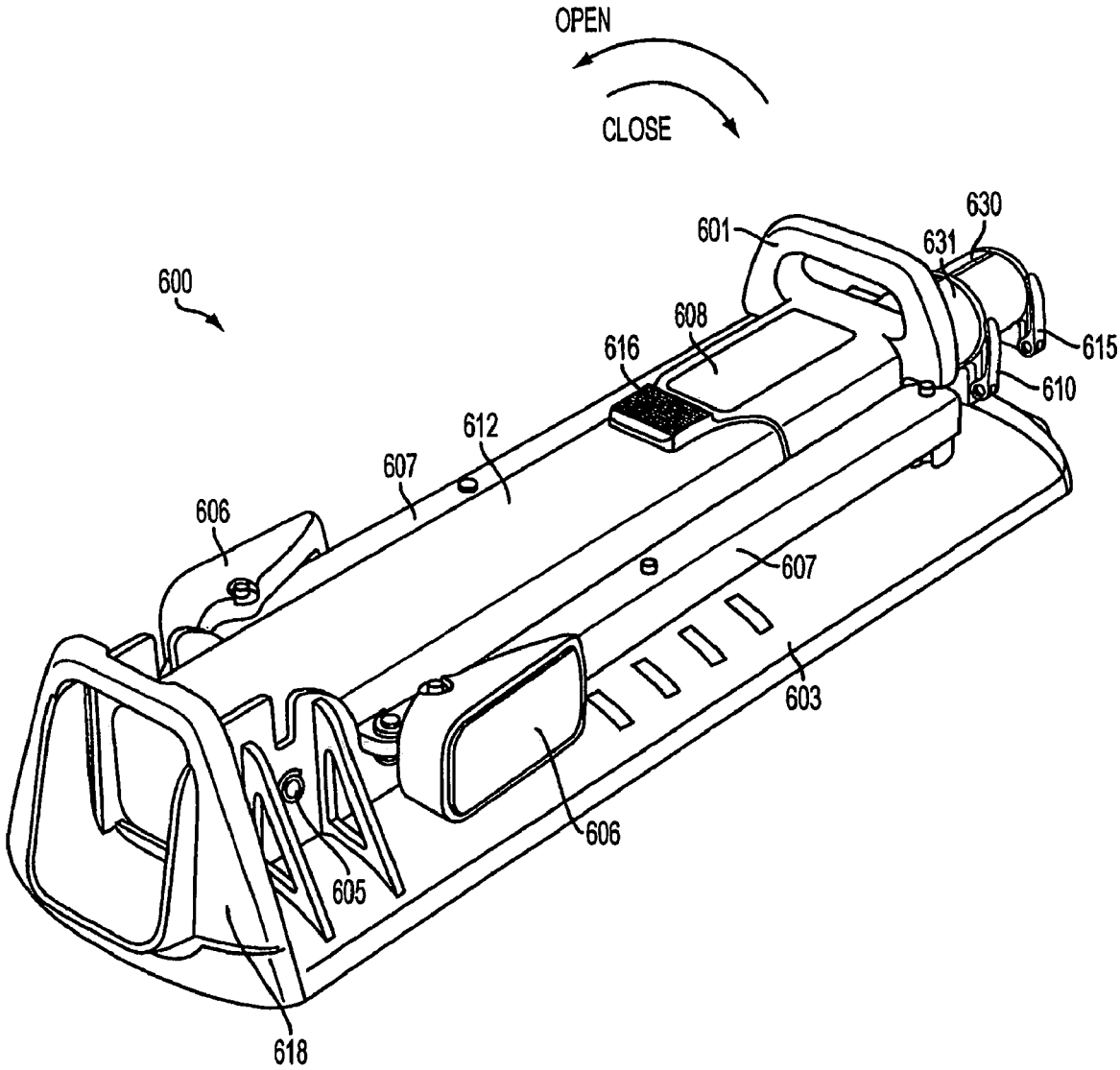
FIG. 17 shows the opposite end of the stand of FIG. 16.

FIG. 17 shows the opposite (front) end of stand 600. Stand 600 includes a pivot 605 allowing trunk 612 (which holds telescoping section 602) to be swiveled to an upright position. Two support feet 606 are attached via hinges to support members 607, which are in turn hingedly attached to collar 608. Opening of support members 607 is described in more detail below. As shown in more detail below, base 603 may be constructed of a metal such as aluminum, such that a car tire can be driven over (and parked on top of) base 603 to hold stand 600 in place and to prevent it from moving. FIGS. 16 and 17 shows stand 600 in its stowed (collapsed) configuration, which makes stand 600 conveniently storable in the trunk of a vehicle.

Figure 18:
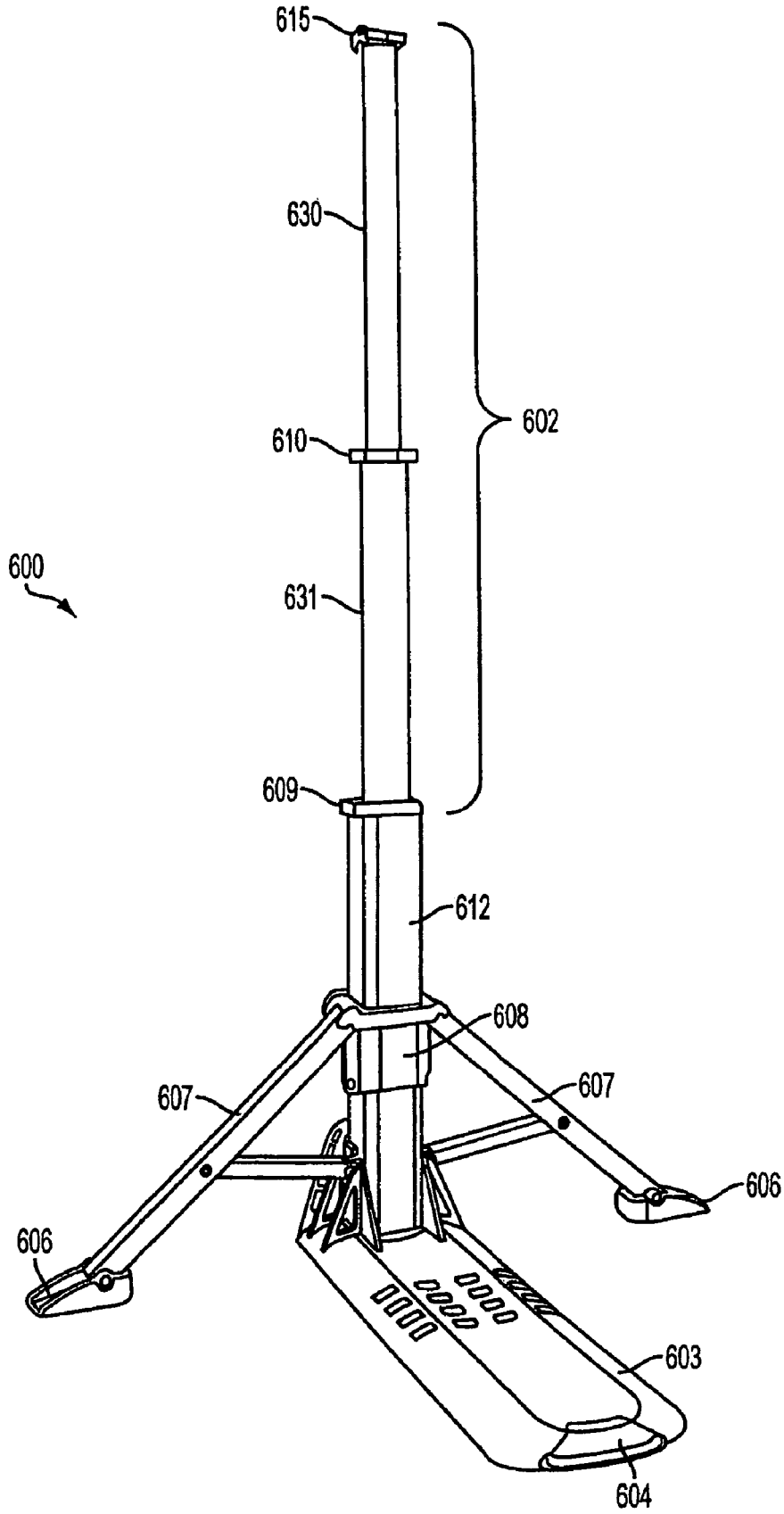
FIGS. 18 and 19 shows the stand of FIG. 16 in a deployed (open) configuration.
Figure 19:
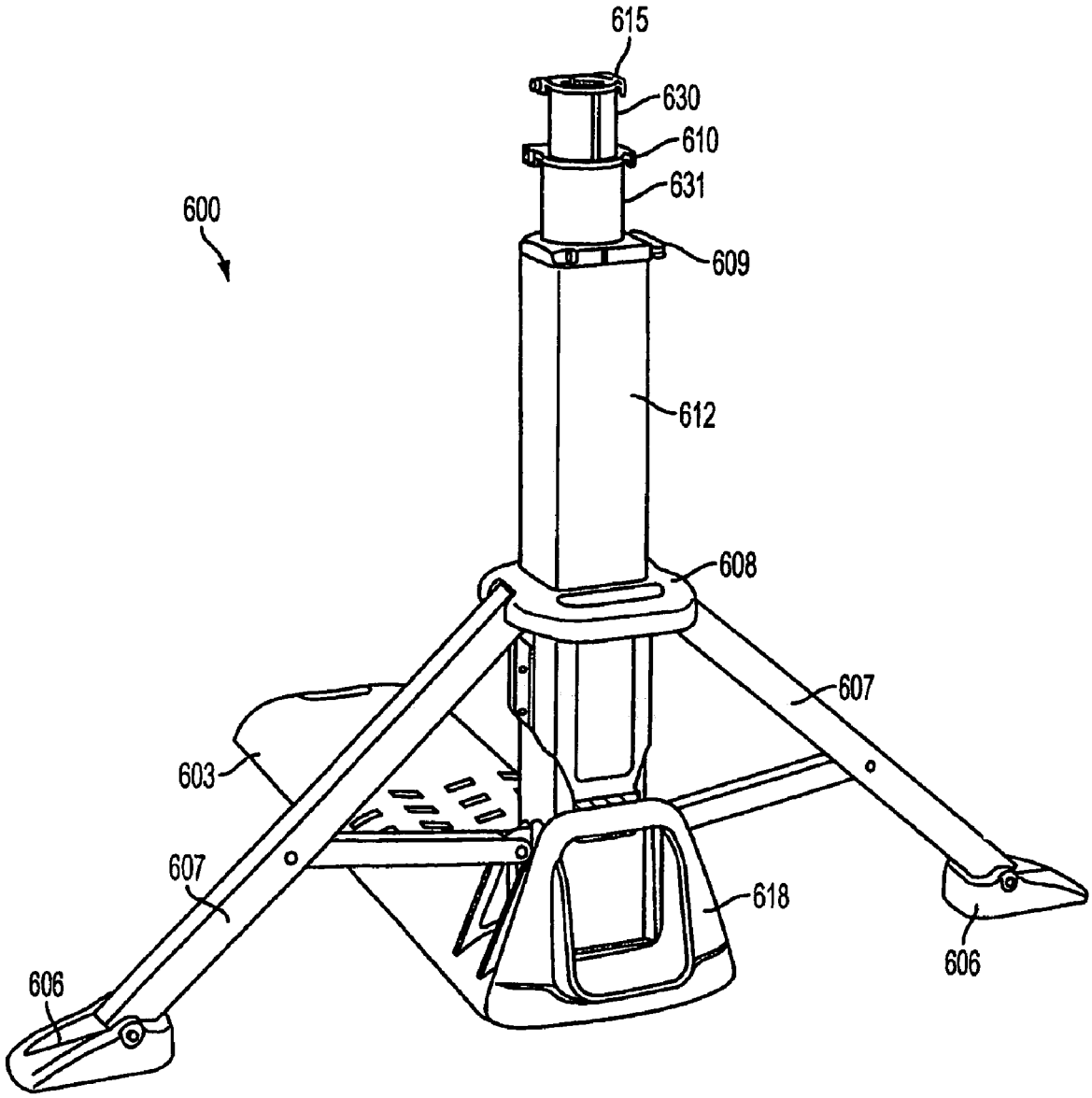

FIG. 18 shows stand 600 in its deployed (open) configuration. Base 603 extends perpendicularly to telescoping member 602, which has been swung away from base 603 at pivot 605 and extended upward. Support members 607 have also been extended so as to place support feet 606 in contact with the ground. Sliding collar 608 moves toward pivot 605 when support members 607 are extended. Telescoping section 602 and trunk 612 provide a column on which a sign can be mounted. Telescoping member 602 is pulled to an extended upright position, providing a suitable height at which to hold a display unit as described in more detail below. As explained above, a vehicle tire can be driven over and parked on base 603 to hold stand 600 place. FIG. 19 shows a front end view of stand 600 in its deployed configuration. Stand 600 can be constructed of metal, plastic, or a combination of materials. In one variation, base 603 is constructed of aluminum or a similar metal to support the weight of a vehicle. Trunk portion 612 holds telescoping section 602 and provides a space into which telescoping section 602 is collapsed when in the closed (stowed) configuration.

Figure 20:
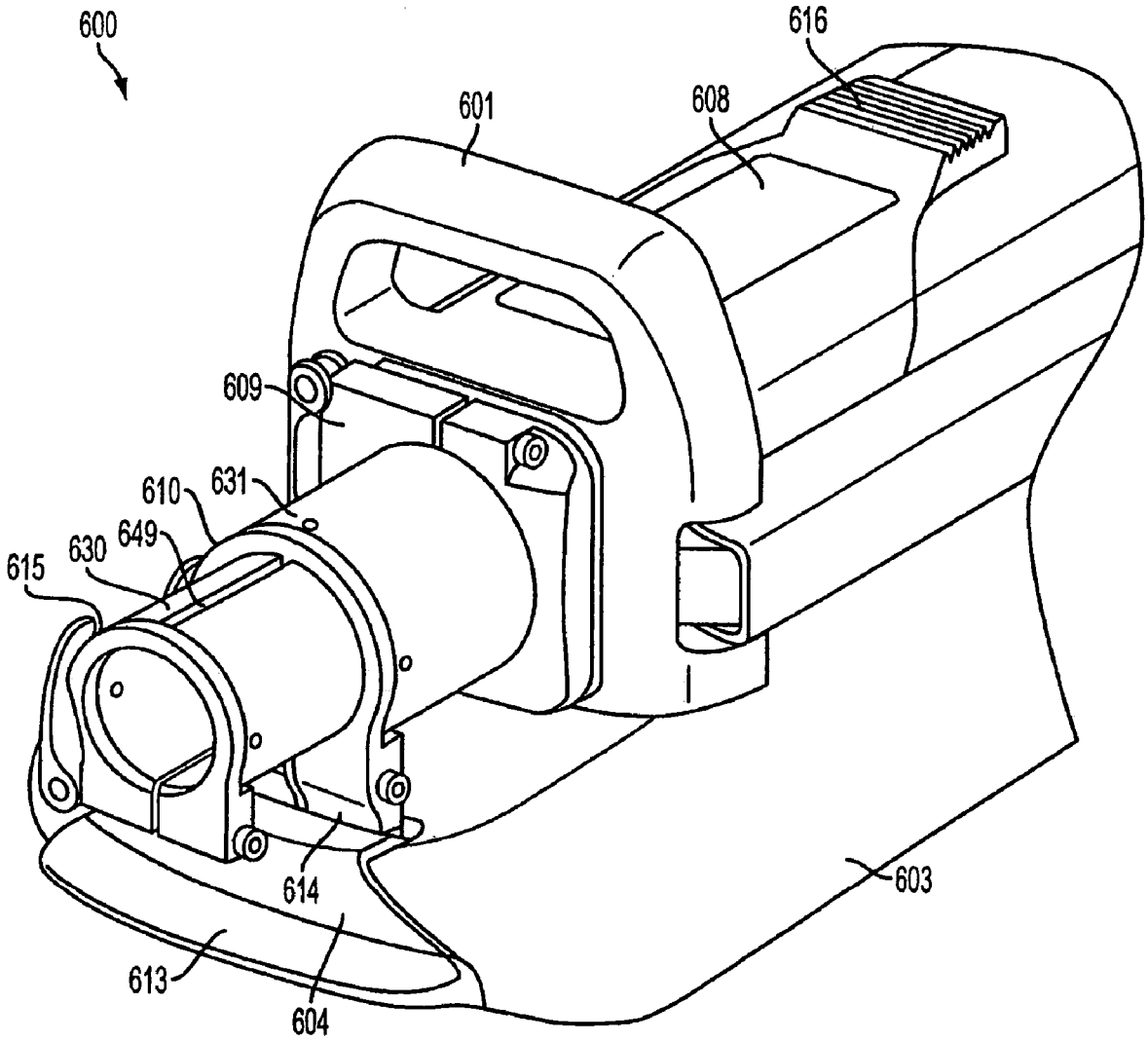
FIG. 20 is an additional view of the stand of FIG. 16.

FIG. 20 shows additional details of the rear end of stand 600 in its stowed (closed) configuration. Handle 601 is formed of a size and shape that permits easy gripping and extension into the upright position. Latch 604 includes a lip 613 that permits a foot to be used to release the latch. A flange 614 extends downwardly from clamp 610 such that when pressed completely down, it engages with latch 604, preventing further movement. Further details of this latch are discussed below. Telescoping member 602 and trunk 612 include clamps 609, 610 and 615. These clamps serve as anti-rotation members to prevent telescoping member 602 from rotating about its axis. Each of clamps 609, 610 and 615 can be moved from an open position (permitting extension and/or tubular rotation of the telescoping section members) to a closed position that narrows the top of the tube (or trunk), thus constricting movement of the telescoping members and any tube (e.g., part of the display panel described below) inserted therein. In particular, closing clamp 609 narrows the end of trunk 612 through which outer tube 631 extends, thereby preventing movement of outer tube 631. Closing clamp 610 narrows the end of outer tube 631 through which inner tube 630 extends, thereby preventing movement of inner tube 630. Closing clamp 635 narrows the end of inner tube 630, thereby preventing movement of any sign portion inserted therein. In at least some embodiments, an anti-rotation detail 649 (e.g., a groove) may be formed in inner tube 630 (e.g., when that tube is extruded). A tab of clamp 610 protrudes into groove 649 to prevent inner tube 630 from rotating.

Figure 21:
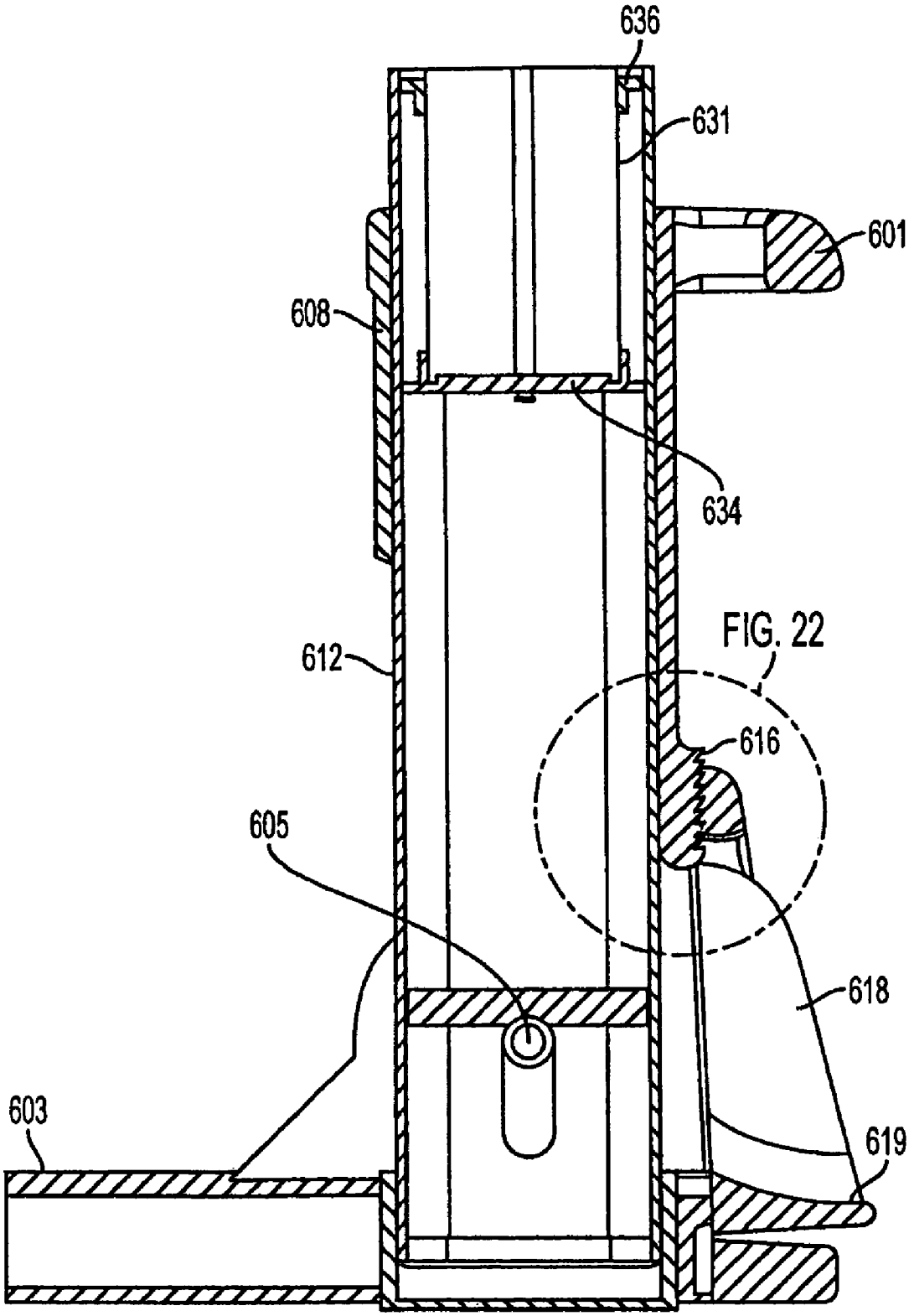
FIGS. 21 and 22 show additional details of latching components, according to at least some embodiments of the invention, which hold the stand of FIG. 16 in a deployed configuration.
Figure 22:
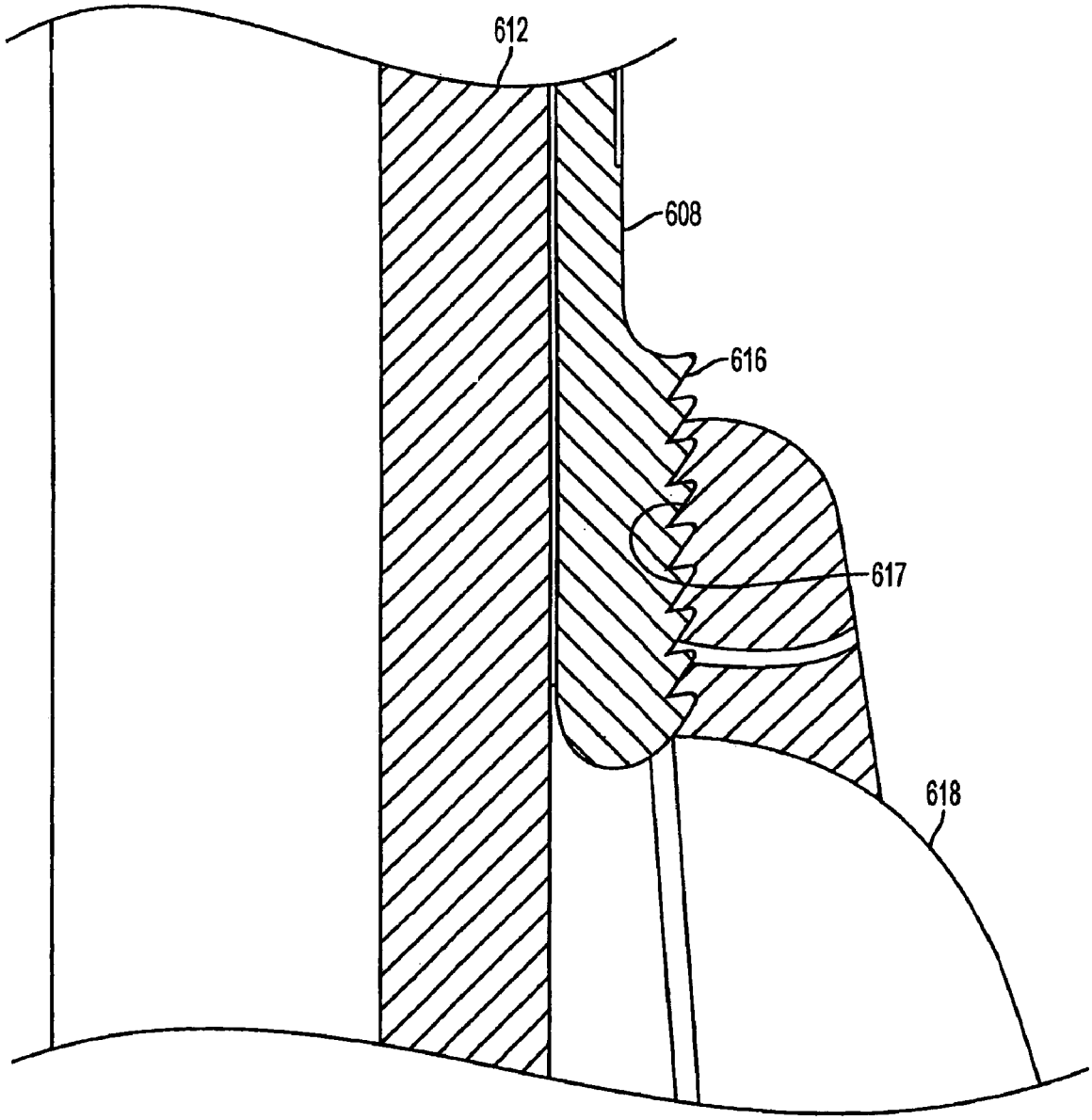

FIGS. 21 and 22 show additional details of latching components, according to at least some embodiments of the invention, which hold stand 600 in a deployed configuration. FIG. 21 is a partial cross section of stand 600 in the deployed configuration. As seen in FIG. 21, collar 608 is located toward the pivot end of trunk 612 when stand 600 is in a deployed configuration. Located at one end of collar 608 are a series of teeth 616. As trunk 612 is raised to the upright position, feet 606 and supports 607 are extended by pushing handle 601 (and thus collar 608) toward the pivot end of trunk 612. Teeth 616 are then engaged by teeth 617 of latch 618. Latch 618 is biased toward trunk 612; when teeth 616 are engaged by teeth 617, trunk 612 is held by latch 618 in the raised position shown in FIG. 21. In order to lower trunk 612 (i.e., to pivot trunk 612 back to the stowed configuration), an operator releases latch 618 by pressing down (e.g., with a foot) on release handle 619, which separates teeth 617 from teeth 616. The operator then pulls up on handle 601 to raise feet 606 and supports 607, and pivots trunk 612 back to the stowed position. FIG. 22 shows the interaction of teeth 616 and 617 in more detail.

Figure 23:
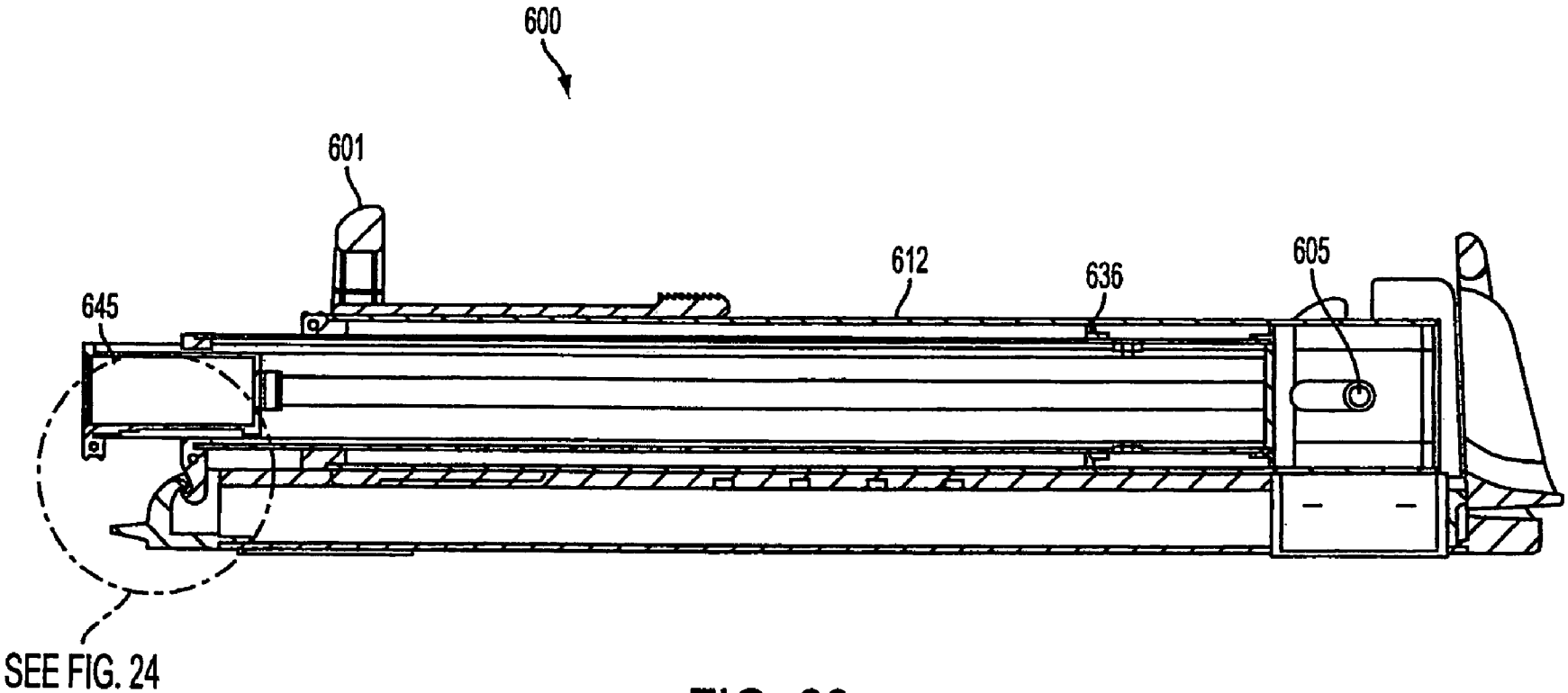
FIGS. 23 and 24 show additional details of latching components, according to at least some embodiments of the invention, which hold the stand of FIG. 16 in a stowed configuration.
Figure 24:
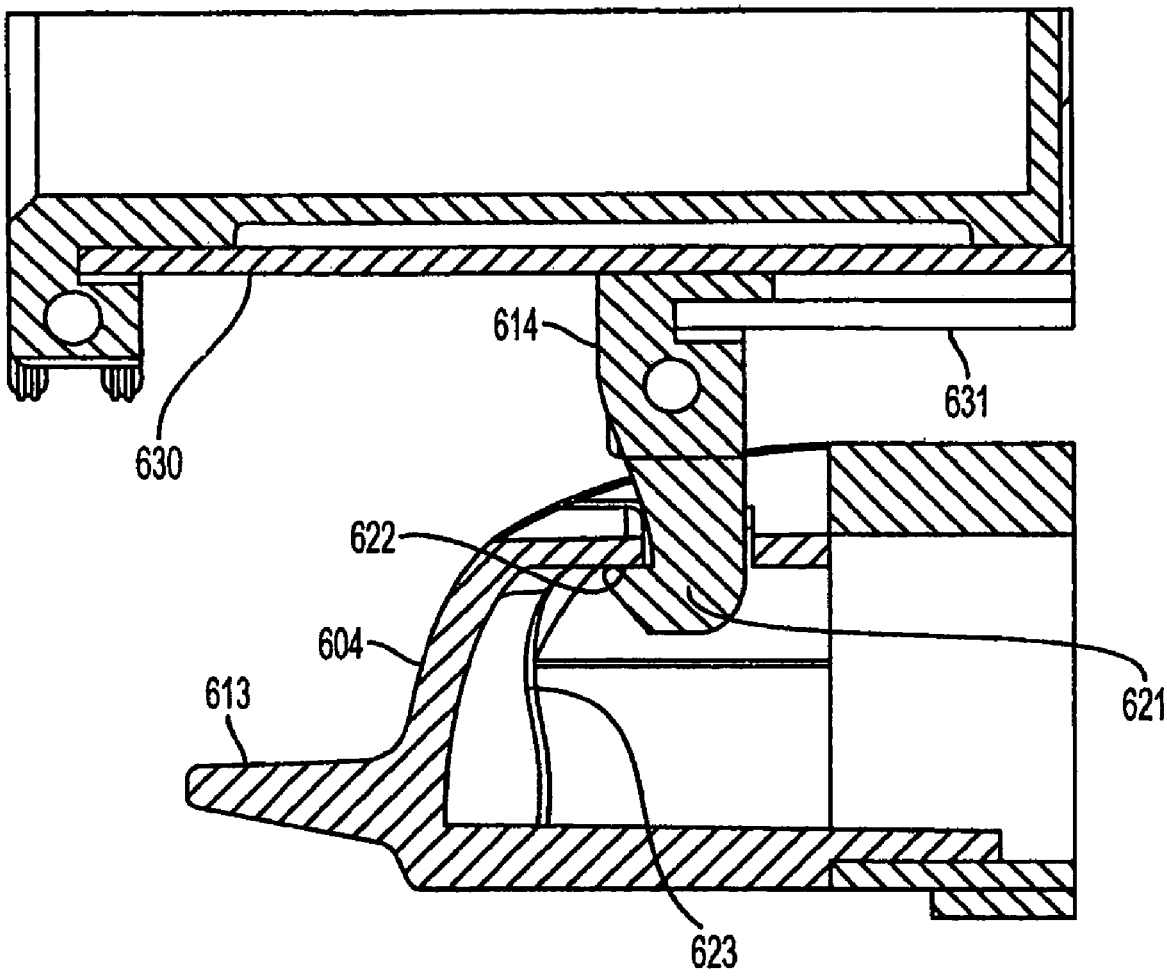

FIGS. 23 and 24 show additional details of latching components, according to at least some embodiments of the invention, which hold stand 600 in a stowed configuration. FIG. 23 is a partial cross-sectional view of stand 600 in the stowed configuration. FIG. 24 is an enlarged view of the region indicated in FIG. 23. As seen in FIG. 24, flange 614 of clamp 610 includes a hook 621 which is retained by an internal lip 622 of a cavity 623 within latch 604. When force is applied to lip 613 of latch 604, hook 621 is released.

Figure 25:
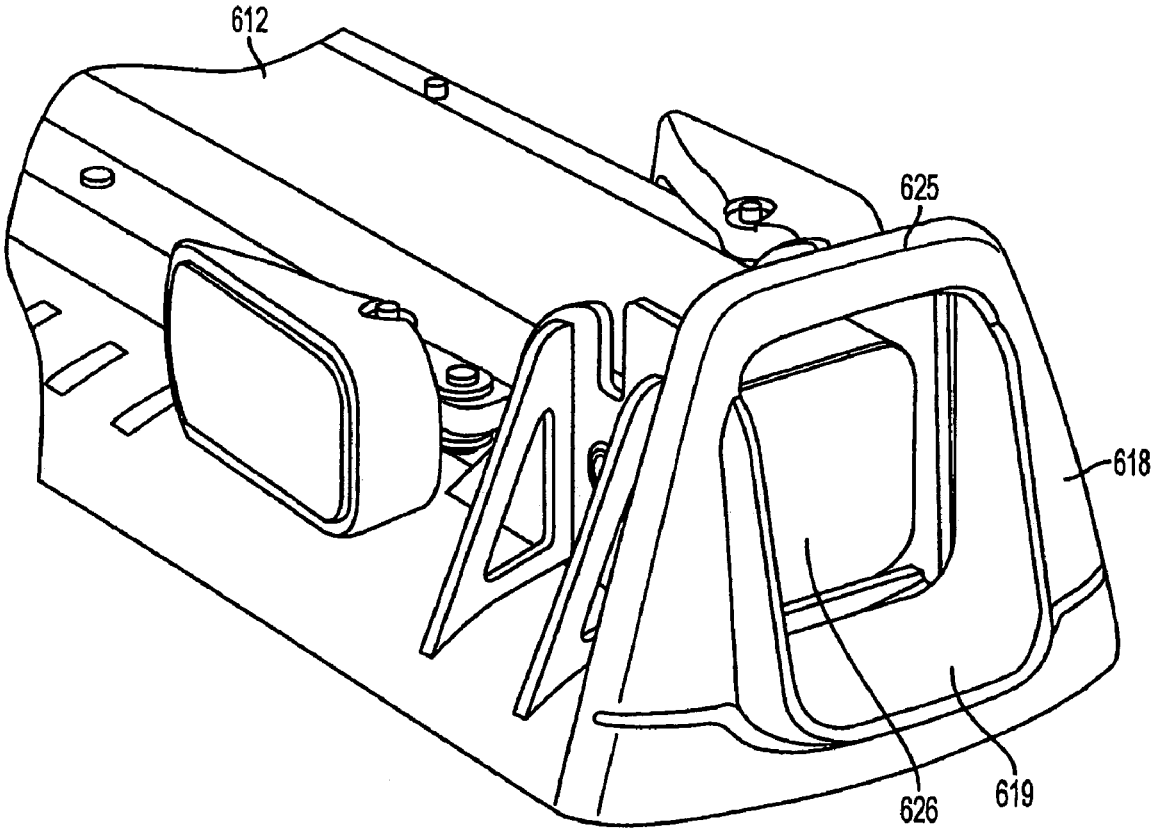
FIG. 25 shows additional details of the front end of the stand of FIG. 16 in its stowed configuration.

FIG. 25 shows additional details of the front end of stand 600 in its stowed position. Latch 618 is formed of durable plastic. A handle 625 is formed in latch 618 and permits the front end of stand 600 to be easily gripped. Trunk 612 (which houses telescoping section 602, not shown in FIG. 25) is made of aluminum or other durable material, and is formed as a square tube having rounded edges. The rounded corners on the square tube provide a better visual appearance and make the tube less likely to be damaged. An end cap 626 made of a durable plastic having rounded corners also helps prevent damage.

Figure 26:
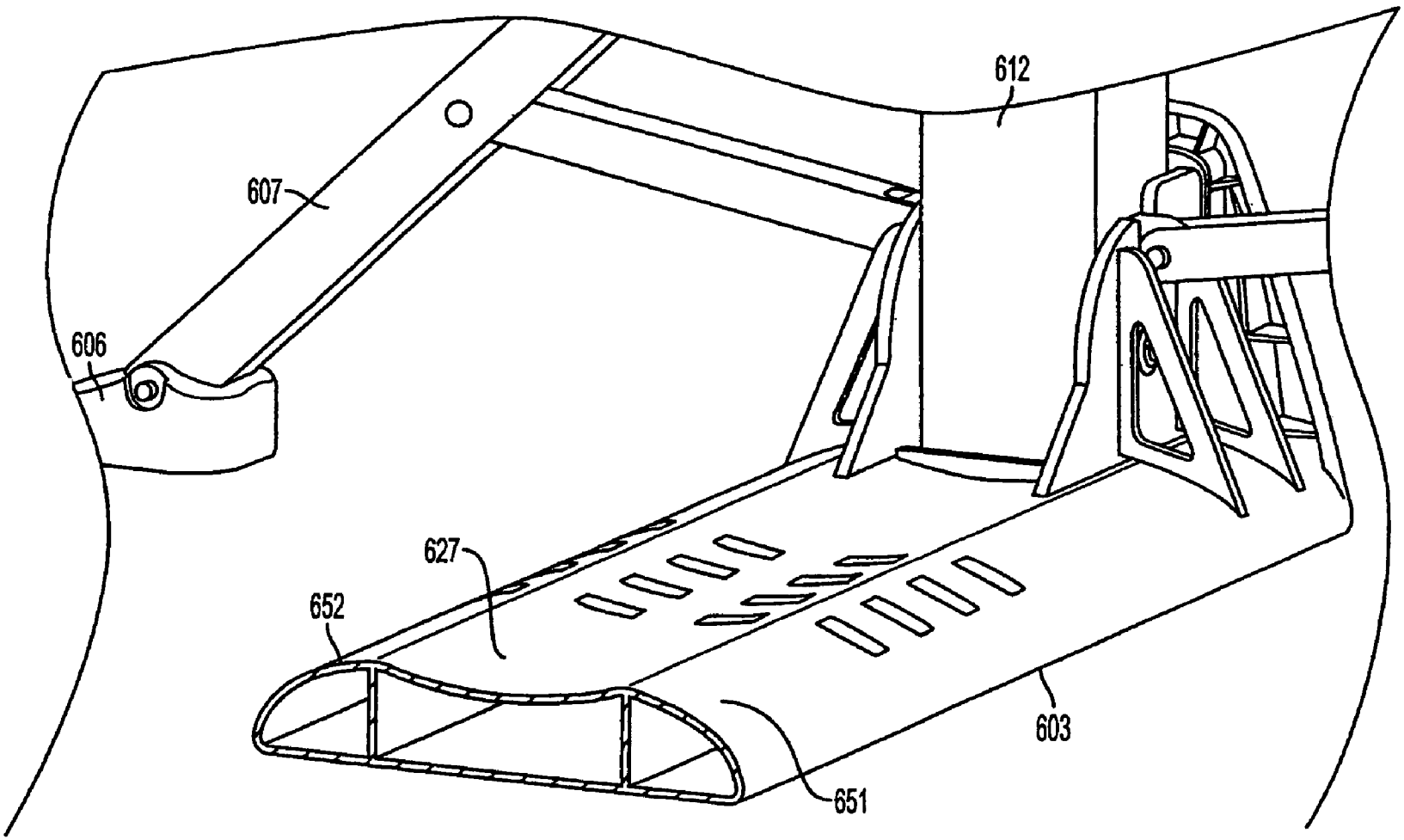
FIG. 26 is a partial cross-sectional view of the stand of FIG. 16, and shows additional details of the base.

FIG. 26 is a partial cross-sectional view of stand 600, and shows additional details of the base 603. As described above, base 603 may be formed of metal such as aluminum. In one variation, base 603 has a cross section defined by a concave center 627 which permits a vehicle wheel to be centered and retained on the base. The base includes ramp-up sides 651 and 652 to permit the vehicle tire to be driven up onto concave center 627.

Figure 27:
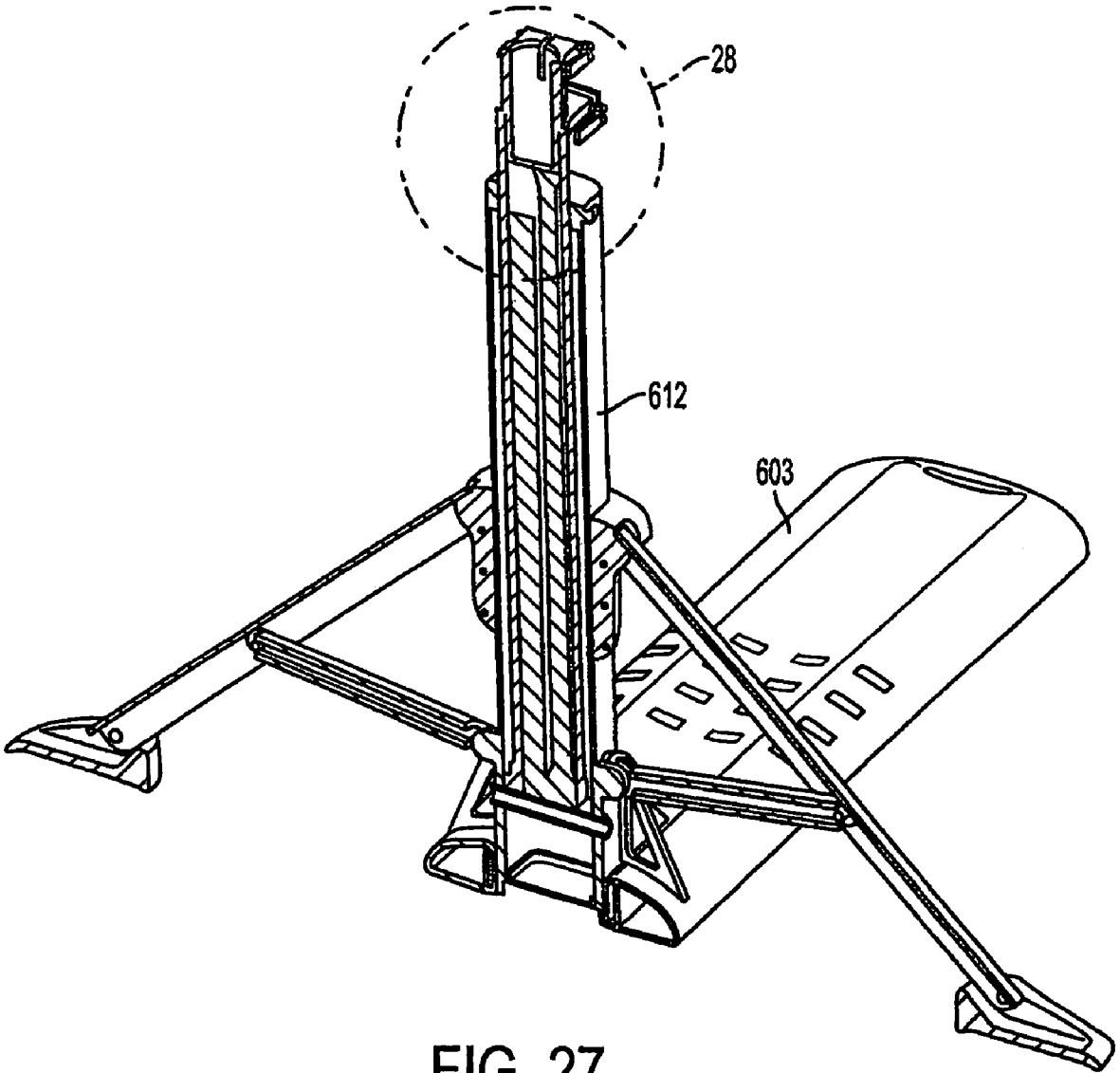
FIGS. 27 and 28 show cross-sectional views of the stand of FIG. 16 in a partially deployed configuration.

FIG. 27 shows a cross-sectional view of stand 600 in a partially deployed position (i.e., trunk 612 is pivoted into a raised position but telescoping member 602 is not extended).

Figure 28:
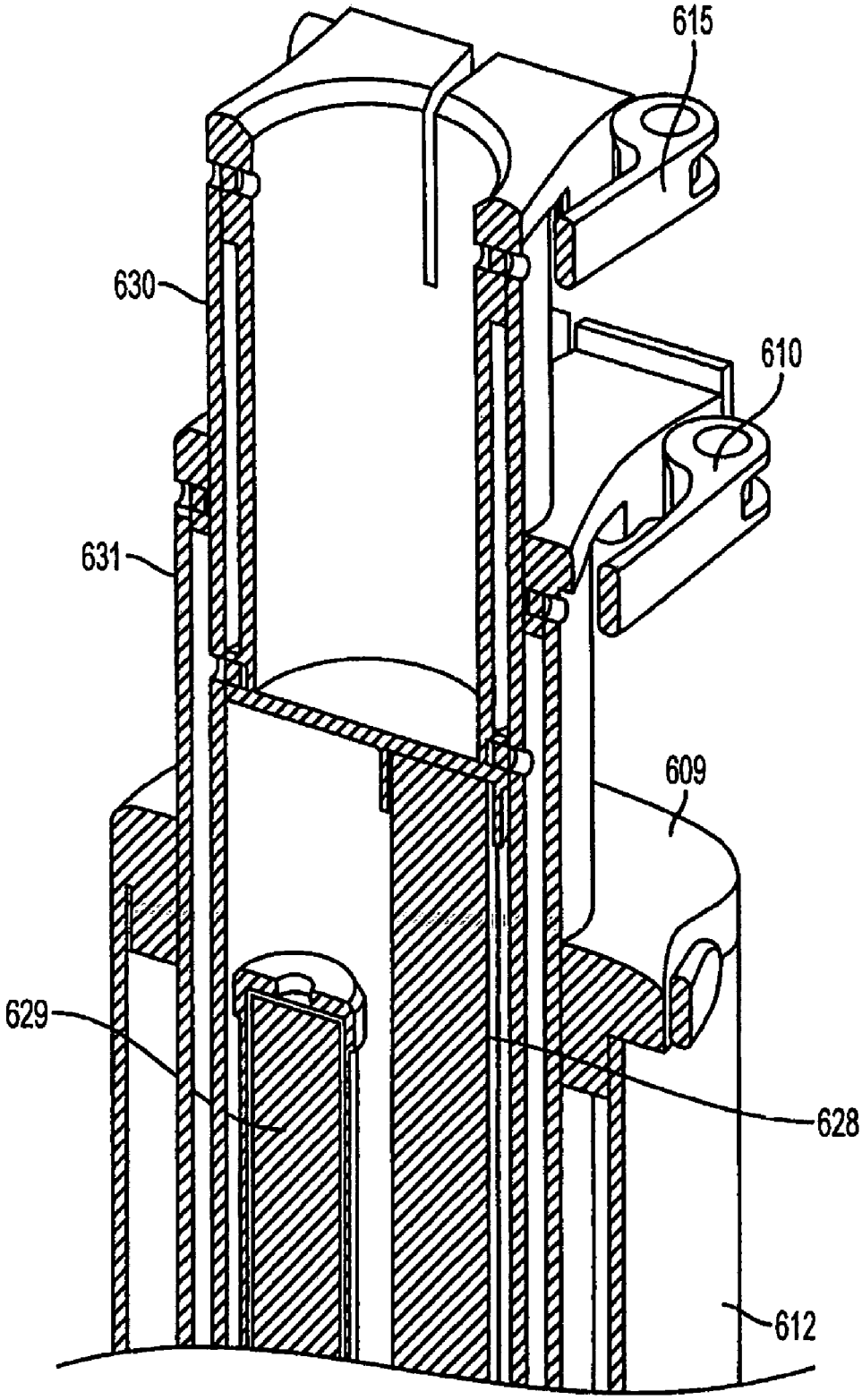
Figure 29:
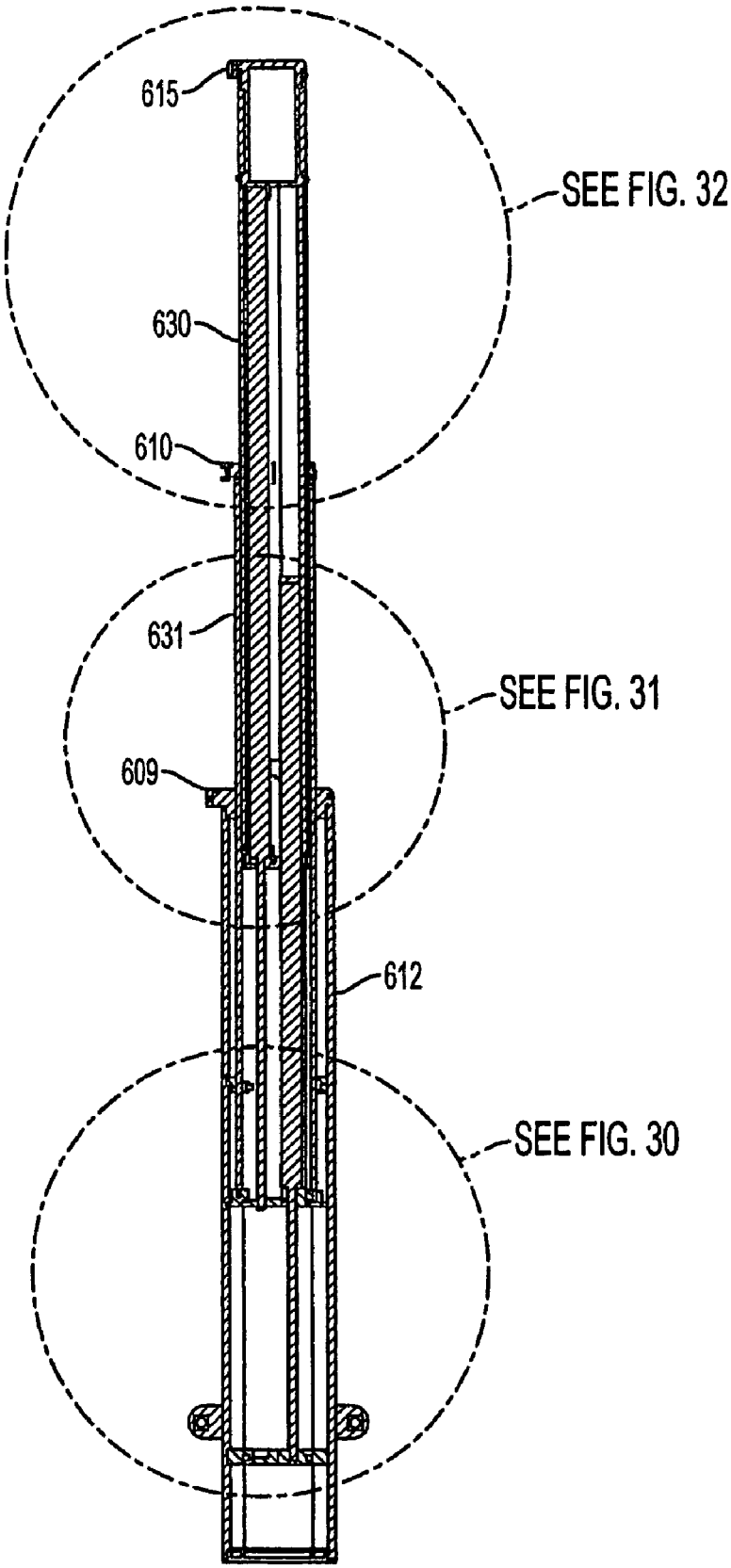
FIGS. 29-32 shows additional details of a gas spring design according to at least one embodiment of the invention.

FIG. 28 is an enlarged view of the region shown in FIG. 27. Seen in more detail in FIG. 28 is the nesting of outer tube 631 and inner tube 630 of telescoping member 602 within trunk 612. In some embodiments, gas springs 628 and 629 are provided within telescoping member 602 to provide easier lifting of the telescoping sections (outer tube 631 and inner tube 630). As shown in FIG. 28, a separate gas spring is provided for each of inner tube 630 and outer tube 631. Gas spring 628 eases lifting of inner tube 630, and gas spring 629 eases lifting of outer tube 631 and inner tube 630. It is of course possible to have fewer or more telescoping members, and the invention is not limited in this respect FIGS. 29-32 shows additional details of the gas spring design according to at least one embodiment of the invention. FIG. 29 is a cross-sectional view of trunk 612, inner tube 630 and outer tube 631. Inner tube 630 and outer tube 631 are partially extended. Notably, FIG. 29 is a cross-sectional view taken from a direction opposite to that in which the cross-sectional view of FIG. 27 is taken. Stated differently, FIG. 27 is a cross-sectional view looking from the front end of stand 600 toward the rear end of stand 600. FIG. 29 is a cross-sectional view looking from the rear end of stand 600 toward the front end of stand 600.

Figure 30:
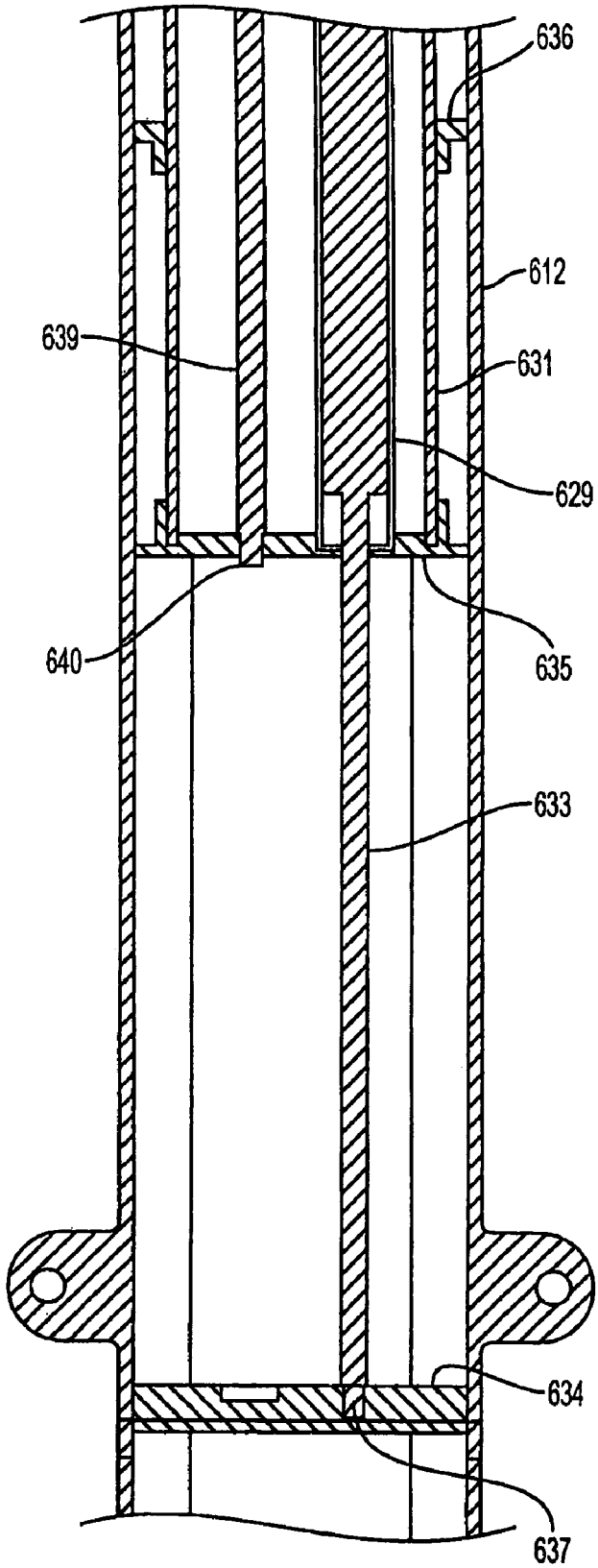
Figure 31:
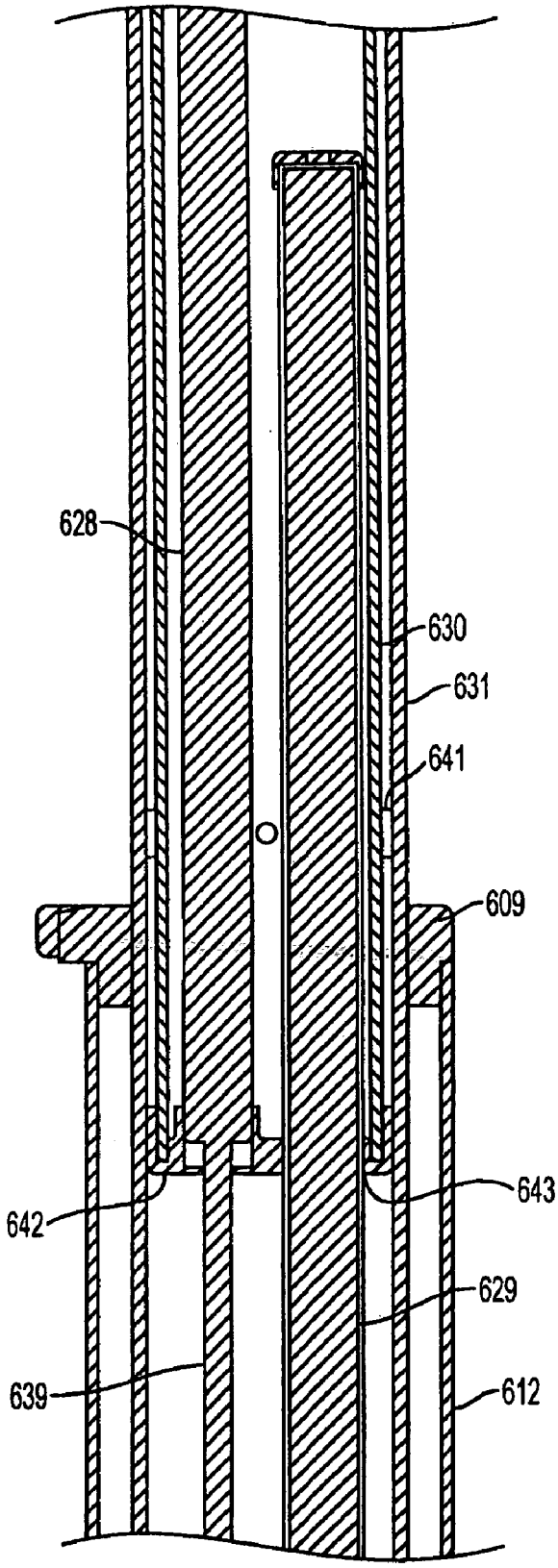
Figure 32:
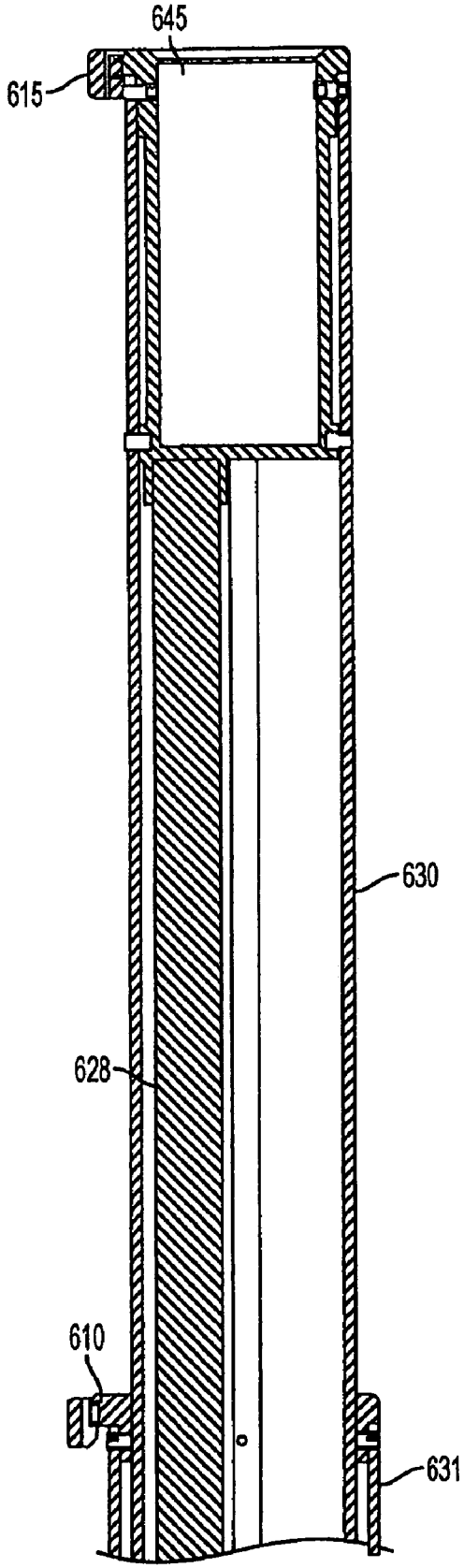

FIG. 30 is an enlarged view of a first portion indicated in FIG. 29. As seen in FIG. 30, the lower end of gas spring 629 is mounted to a mounting plate 635; mounting plate 635 is attached to the lower end of outer tube 631. Gas spring 629 includes an extension rod 633. A distal end 637 of extension rod 633 is attached to lower spring mount 634. Also seen in FIG. 30 is a distal end 640 of extension rod 639 for gas spring 628. Other parts of gas spring 628 are not shown in FIG. 30, but are shown in FIGS. 31 and 32. Distal end 640 is attached to mounting plate 635. A stop 636 is attached to outer tube 631. Stop 636 abuts the underside of clamp 609 (seen in FIG. 31) when outer tube 631 is raised, and prevents outer tube 631 from leaving trunk 612.

FIG. 31 is an enlarged view of a second portion indicated in FIG. 29. The lower end of gas spring 628 is attached to mounting plate 642. Mounting plate 642 is attached to the bottom end of inner tube 630. Extension rod 639 extends from the bottom of gas spring 628 through an opening in mounting plate 642. The outer body of gas spring 629 slides through a larger opening 643 in mounting plate 642. Stop 641 is attached to inner tube 630. As inner tube 630 is raised, stop 641 abuts the underside of clamp 610 (shown in FIG. 32).

FIG. 32 is an enlarged view of a third portion indicated in FIG. 29. Attached to inner tube 630 at the upper end is a receptacle 645 for holding an attachment post or portion of a sign. Clamp 615 at the end of outer tube 630 allows the sign attachment post or other portion to be secured in receptacle 645. The upper end of gas spring 628 is attached to the bottom of receptacle 645.

In operation, telescoping member 602 can be extended by releasing clamp 609 at the end of trunk 612 (see FIGS. 29 and 31). Gas spring 629 then pushes extension rod 633 against spring mount 634 (see FIG. 30), thereby raising outer tube 631 and inner tube 630. When clamp 610 (FIG. 32) is released, the force of extension rod 639 against mounting plate 635 (see FIGS. 30 and 31) raises inner tube 630.

Figure 33:
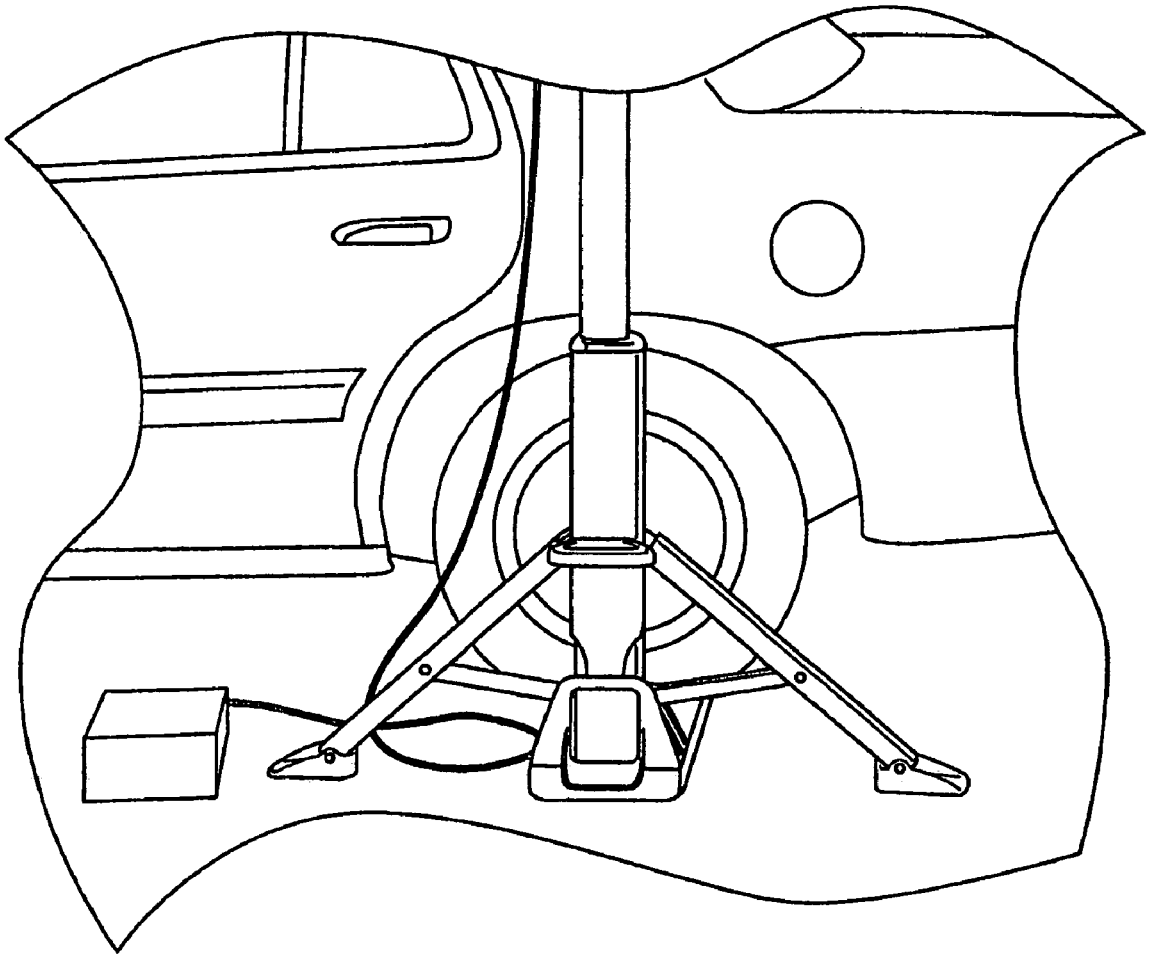
FIG. 33 shows the stand of FIG. 16 in its deployed configuration and with a vehicle tire positioned onto the stand base.

FIG. 33 shows stand 600 in its deployed (open) configuration, wherein a vehicle tire has been positioned onto base 603 in order to hold stand 600 in place.

Display Panels

Figure 34:
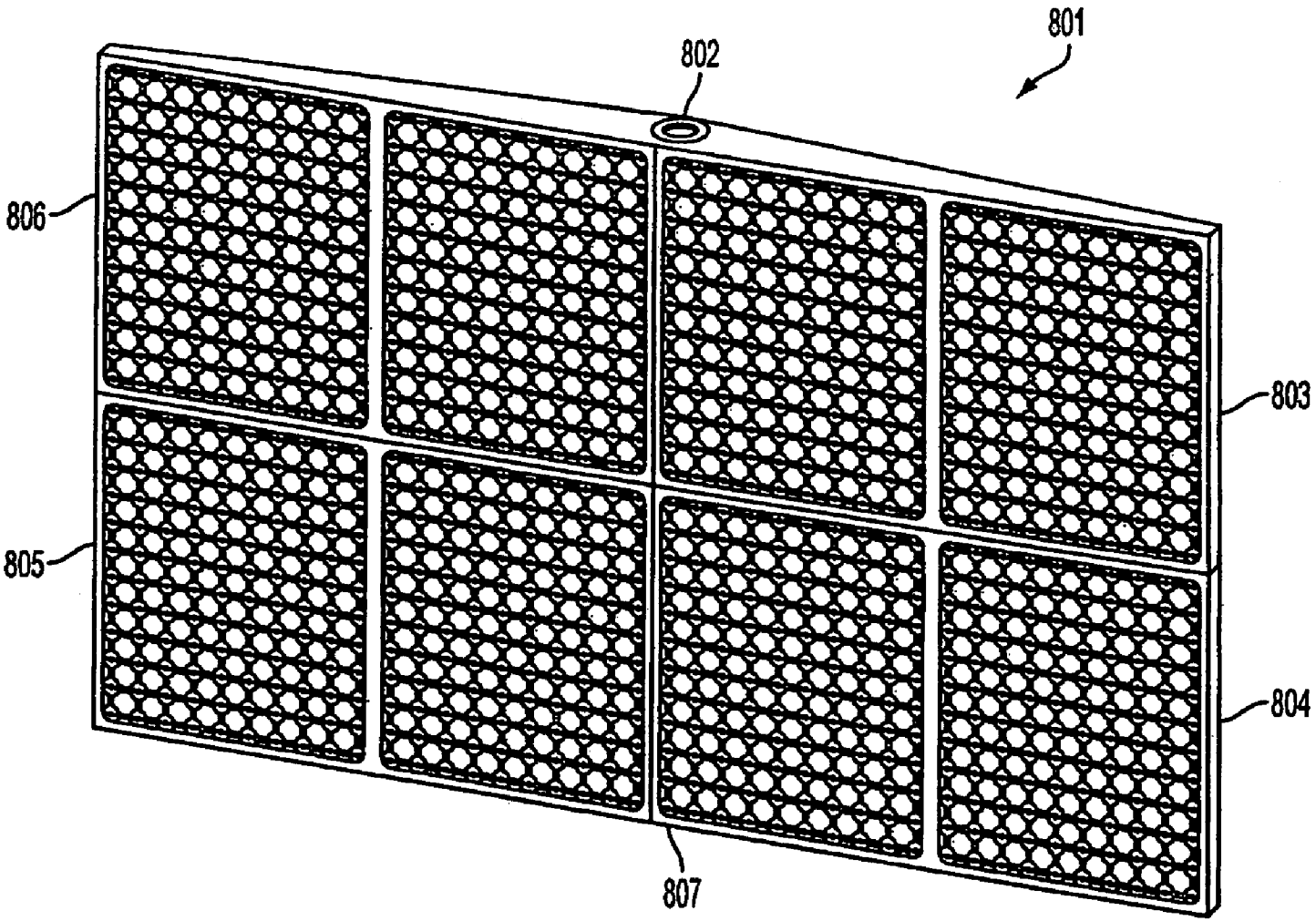
FIG. 34 shows at least one embodiment of a display panel.

FIG. 34 shows at least one embodiment of a display panel 801 that can be placed atop and joined with the telescoping section 602 of stand 600 described above. Display panel 801 generally includes four panel members 803, 804, 805, and 806 that are joined to a central axis member 802. Central axis member 802 may be formed of an aluminum tube or similar construction, and may extend below the panel members shown in FIG. 34. Each panel may comprise a frame portion made of a sturdy material, such as aluminum, and be partitioned into one or more sub-panels. As described in more detail below, the display elements are in turn fixed to the frame portion to provide support.

As shown in the embodiment of FIG. 34 and as described below, display panel 801 includes four panel members, each of which may be swiveled about central axis 802. Each panel member defines two sub-panels, with each sub-panel supporting an associated element of the display. It should be understood that more or fewer panel members may be used, and each panel member may support one, two, or more display elements. Each display element, as described above and in more detail below, may be formed in such a way as to be transparent to wind forces, while still providing a bright display. For example, each display element may be formed of a mesh design having LEDs positioned at junctions in the mesh.

In a deployed configuration, display panel 801 is positioned atop telescoping section 602 of stand 600, with a bottom portion of the pivoting axis member 807 inserted into the top of the telescoping section (i.e., into receptacle 645 of inner tube 630). One or more anti-rotation clamps 609, 610, 615 (see FIGS. 16, 18 and 29-32) can then be moved into the closed position, preventing rotation of the central axis member 802.

Figure 35:
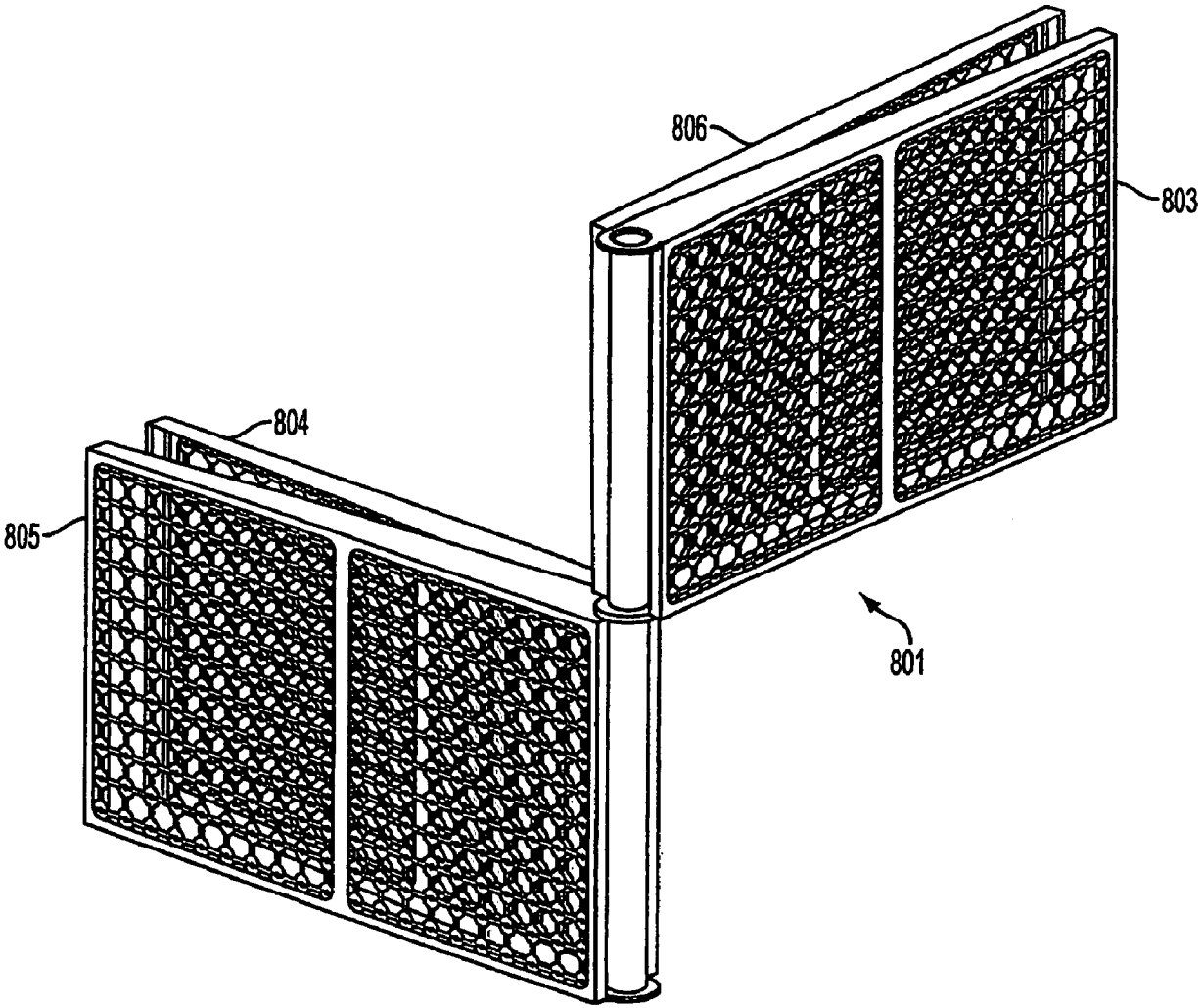
FIG. 35 shows the display panel of FIG. 34 in an alternate configuration.

FIG. 35 shows how display panel 801 has been configured to have four separate panel members, wherein two of the top panel members 803 and 806 are generally parallel to each other, and two of the bottom panel members 804 and 805 are also generally parallel to each other, but wherein the two sets of panel members are generally perpendicular to each other. As explained below, this configuration may be useful for displaying messages in two different directions simultaneously, as might occur at an intersection.

Figure 36:
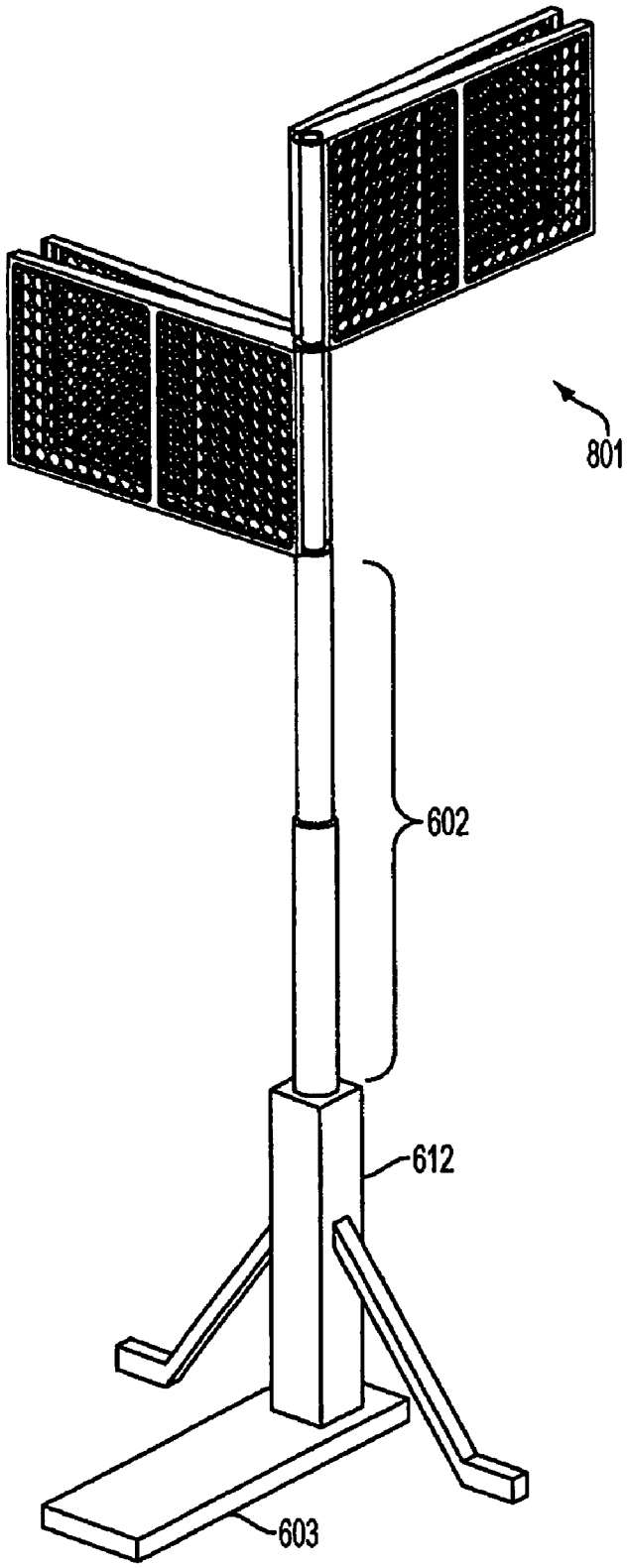
FIG. 36 shows the display panel of FIG. 34 positioned on a stand.

FIG. 36 shows display panel 801 positioned atop telescoping section 602, which has been extended from trunk 612, which is in turn joined to base 603. This configuration permits one, two, three, or four different or identical messages to be displayed in four different directions (one per display member). The messages could include traffic instructions, stoplight controls, police instructions, advertising, or virtually any other type of message.

Figure 37:
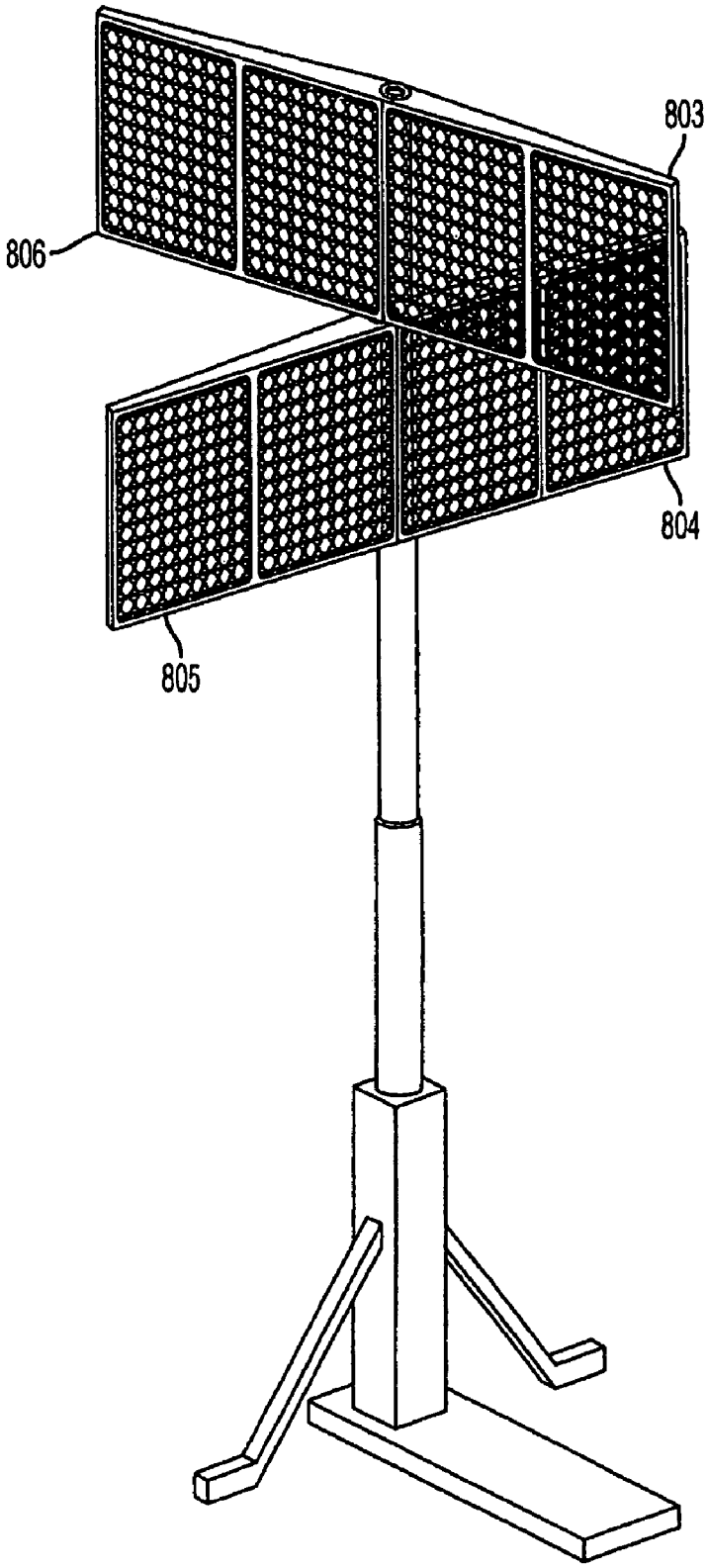
FIG. 37 shows the display panel of FIG. 34 positioned on a stand and in an alternate configuration.

FIG. 37 shows an alternative configuration in which the panel members have been arranged in two perpendicular directions, which provides a wider message area in both directions. Referring again to FIG. 34, the four panel members can be configured together to face the same direction, thus providing a larger display surface. Other alternatives are of course possible, and the invention is not limited in this respect. The panel members could also or instead be configured to extend in an upwardly direction.

Figure 38:
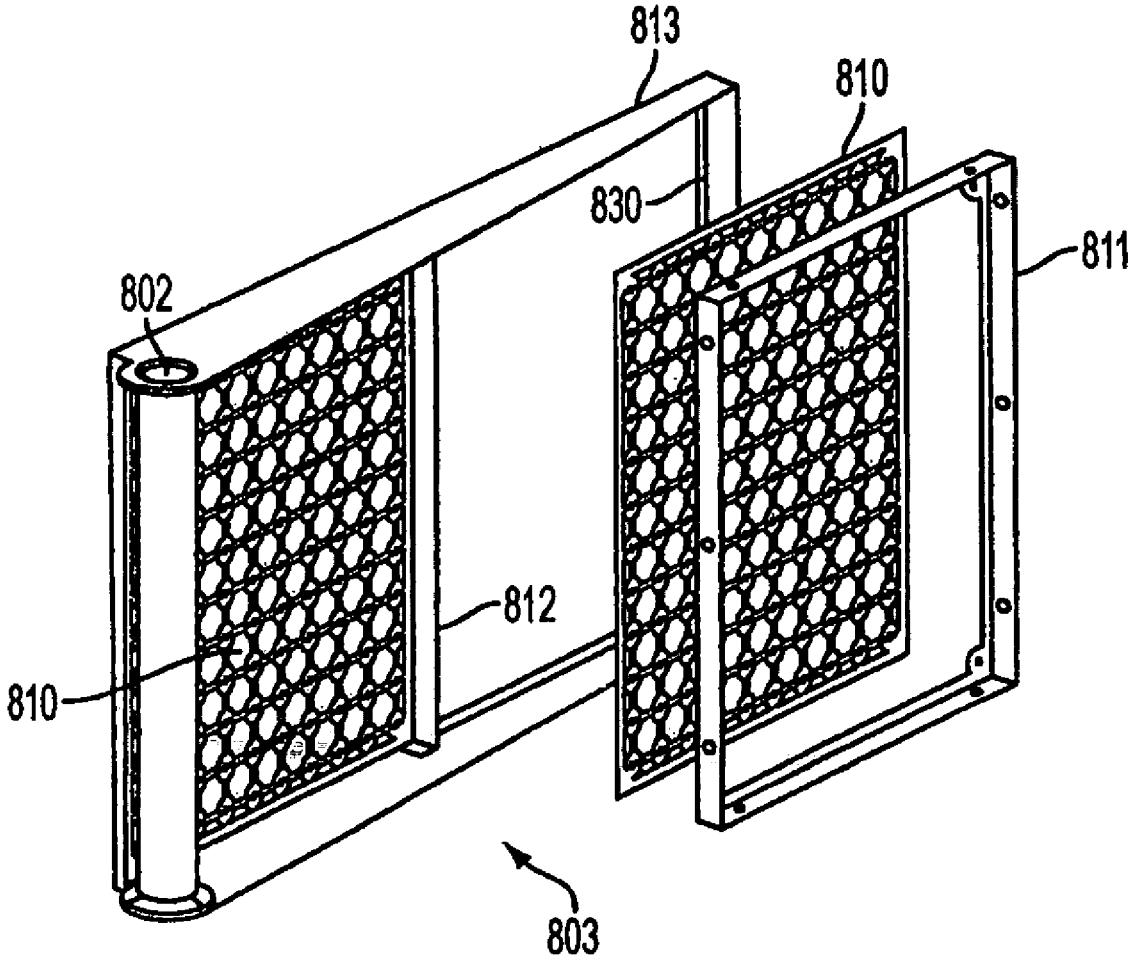
FIG. 38 shows an exploded view of one display panel member.

FIG. 38 shows an exploded view one panel member 803. The panel member includes a generally rectangular aluminum frame 813 having a tapered edge, and a tubular section 802 that can be joined with the rectangular fame of another panel member (e.g., panel member 806 in FIG. 34). In one embodiment, the frames of two panel members are joined to tubular section 802 and can be rotated independently. The tubular section can be affixed to the telescoping section 602 of base 600 described above. Other methods of attaching the display panel to the base can of course be used.

In one embodiment, two display elements 810 each comprising a routed printed circuit board (PCB) having pixels formed from light-emitting diodes (LEDs) at each junction are attached to frame 813 and secured by a frame retaining element 811. The routed PCB may comprise a multi-layered structure with conductors traversing in vertical and horizontal directions, separated by an insulating layer, such that each pixel can be activated by energizing a corresponding X and Y conductor. Various techniques for manufacturing such a PCB are shown in U.S. patent application Ser. No. 10/847,343, filed on May 18, 2004, entitled LED Assembly With Vented Circuit Board Design, to Robert Raos et al., hereby incorporated by reference. Instead of a routed PCB, each display element may comprise a mesh of insulated conductors having spaces for air flow, wherein one or more LEDs are positioned at each mesh junction. Various other approaches are shown in the previously-incorporated '185 application.

Each display element 810 may be formed in any of various dimensions, such as 18 inches by 30 inches, and having 20 pixels in the horizontal direction 12 pixels in the vertical direction. Each pixel may comprise four LEDs configured to be illuminated simultaneous to maximize the amount of brightness per pixel. In one exemplary embodiment, a pixel spacing of 1.5 inches is used, and the holes in the PCB permit wind to pass through with a minimum of resistance. In one embodiment, each display element may provide an aerodynamic loading that is approximately 25% of the wind loading that would occur if a solid panel were used. In one embodiment, a contrast screen (see FIG. 15) is used to increase visual contrast while minimizing wind resistance.

One or more support members 812 may be provided to increase the structural rigidity of aluminum frame 813. Retaining element 811 engages each display element with an inner lip 830 of the frame 813 such that the display element is secured. It should be understood that more or fewer display elements may be used to construct each display panel, and that more or fewer display panels may be used than are specifically shown. The use of aluminum or similar metals for the frame helps act as a heat sink for dissipating heat from the LEDs generated during operation.

Electrical signals can be supplied to the display elements in any of various ways. In one embodiment, electrical cables are run through the body of telescoping section 602 and branch out to each display element. Alternatively, electrical connectors can be attached to each display panel and signals can be run via ribbon cables or similar means. Waterproof connectors can be used to connect the signal and power.

Figure 39:
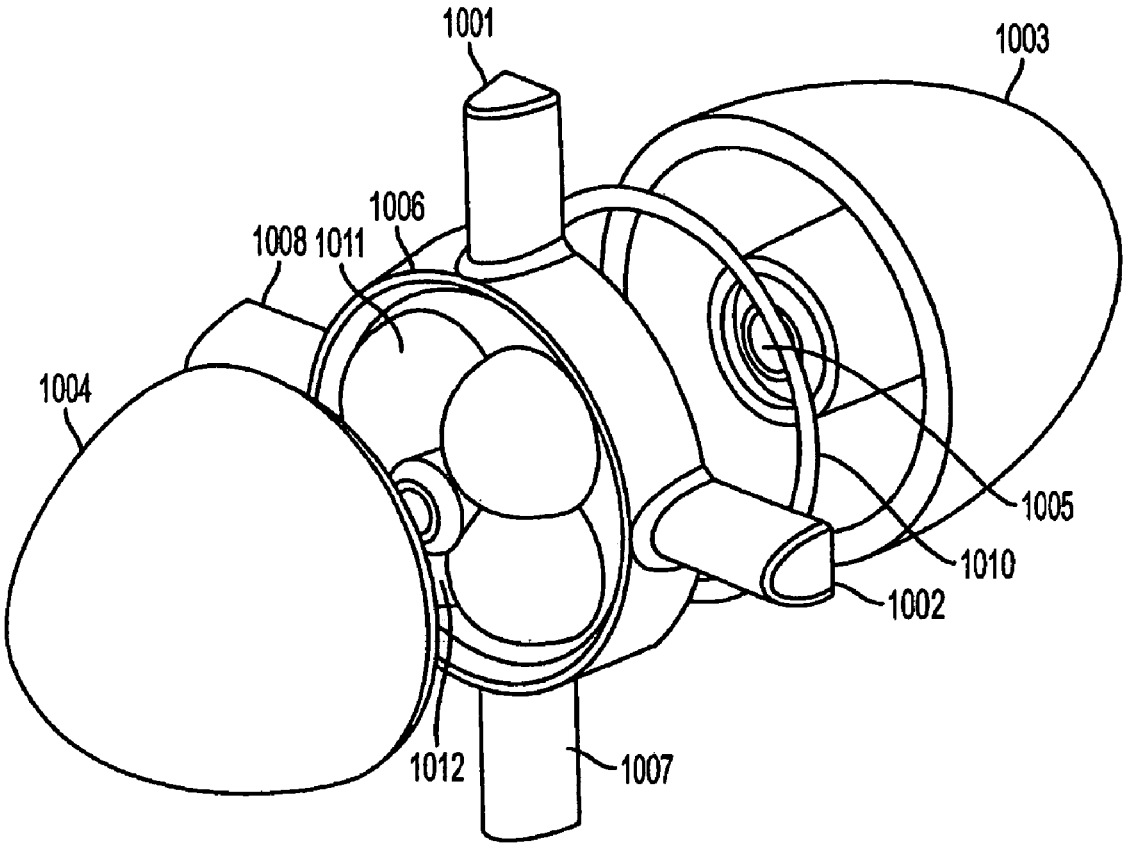
FIG. 39 shows an exploded view of one pixel element.

FIG. 39 shows an exploded view of one pixel element, including aerodynamic caps or fairings 1003 and 1004. The pixel is positioned at the junction of an X-direction member and a Y-direction member, which as mentioned above may comprise a portion of a routed PCB or a mesh of X-and Y-directional insulated conductors of the type illustrated in the '185 application. Each pixel may comprise one, two, three, four, or more LEDs that are energized through electrical signals transmitted along the X- and Y-directional members. The fairings 1003 and 1004 assist in reducing wind loading and may provide other features such as UV protection for the internal components and/or optical features such as magnification or beam focusing, or directional beam placement (up, down, or elliptical patterns, for example). The front fairing or dome 1004 may be manufactured with an integrated dye that is transparent to LED wavelengths (e.g., 592 nm) while providing protection against the sun.

As shown in FIG. 39, front fairing 1004 covers the pixel and is joined to a base portion 1006 secured to the surface of the PCB. The front fairing may be joined using ultrasonic welding or other means. A rear fairing 1003 is joined to the back of the pixel junction and may comprise an opening 1005 through which a screw may be threaded to secure the fairing to the unit. As seen in more detail below, a portion of a PCB is disposed between base 1006 and rear fairing 1003 after installation Contoured fairing portions 1001, 1002, 1007, and 1008, which cover the cross-members of the mesh or PCB, also help reduce wind loading on the cross-members of the display. One or more O-rings 1010 or similar hardware may be used to help seal each pixel element. Four separate LEDs are included under fairing 1004 and described in more detail below. One or more internal resistors (not shown) may be used to defog each pixel when necessary. Other approaches are of course possible. The rear fairing may also be constructed of a material (e.g., metal) to act as a heat sink, drawing heat away from each pixel.

Figure 40:
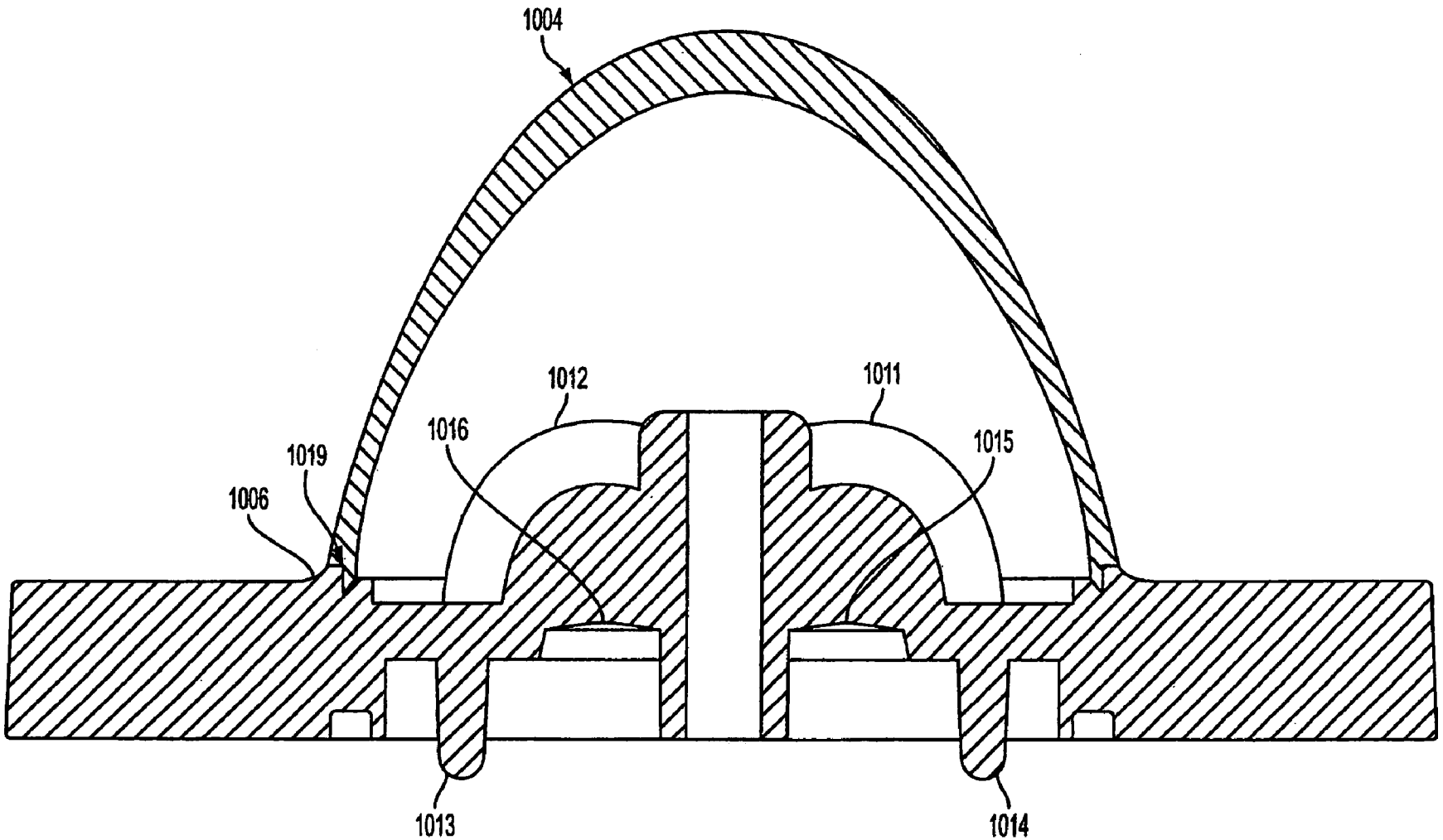
FIG. 40 shows a cross-sectional view of one pixel.

FIG. 40 shows a cross-sectional view of one pixel, according to one possible design. The pixel comprises a base portion 1006 including two alignment pins 1013 and 1014 that can be used to align the pixel to the PCB using holes provided therein (see FIG. 41). Base 1006 can be made of a durable plastic or other material. Fairing (or dome) 1004 can be welded to the base using ultrasonic welding for example. Two LEDs 1015 and 1016 are positioned atop stands and project light through lenses 1011 and 1012 respectively. (Since it is a cross-sectional view, only two of the four LEDs are visible in FIG. 40). Lenses 1011 and 1012 focus the light emitted from each LED to obtain maximum brightness and focus. The specific optics parameters may be selected to meet any of various requirements, such as federal, state, or local requirements for road signs, or may be selected based on commercial considerations. One possible set of optics parameters is provided in Appendix B to U.S. Provisional Application Ser. No. 60/619,966, which application is incorporated by reference herein.

In one variation, a bare LED without optics is surface mounted on a printed circuit board. By itself, the LED would radiate in a roughly hemispheric beam pattern. Traditionally, a desired beam pattern is achieved through integrated optics (one example of which is known as a T1¾ package). In one variation, an external hemispheric lens is accurately positioned over the surface mounted LED. This implementation achieves a custom beam pattern, instead of the limited varieties of integrated optics provided by manufacturers. In addition, thermal properties (e.g., heat transfer) may be improved. This approach permits accurate relative placement of the LEDs and their external (detached) lenses through the use of traditional automated placement techniques for the LEDs (such as "bomb sighting") combined with placement pins that are an integral part of the lens array.

The external optics permit precise customization of the resulting beam pattern from any number of LEDs. Beam patterns that can be produced include limited field of view (for example, +/−15 degrees), elliptical patterns (for example, narrower from side to side to reflect the limited width of highways), no sunward illumination (since cars don't drive "above" the sun), and no illumination directly downwards (since cars underneath the sign are driving too fast to see it). An option available with external optics is to dye the plastic from which the optics are made with a dye which transmits the light emitted by the LED but absorbs all other wavelengths. This has the benefit of increasing the contrast of the display by reducing ambient light reflections.

In an alternative implementation, the desired beam pattern can be formed through a combination of the lens army and the forward aerodynamic dome. This implementation distributes the optical power over both components, as opposed to using an optically-neutral forward dome. One of the advantages of this design is to improve the placement tolerances, so that small errors in the relative positions of the lens array and LEDs have less impact on the resulting beam pattern. Another advantage of this design is to permit a thicker wall for the forward dome, making its dimensions more compatible with injection molding techniques.

Figure 41:
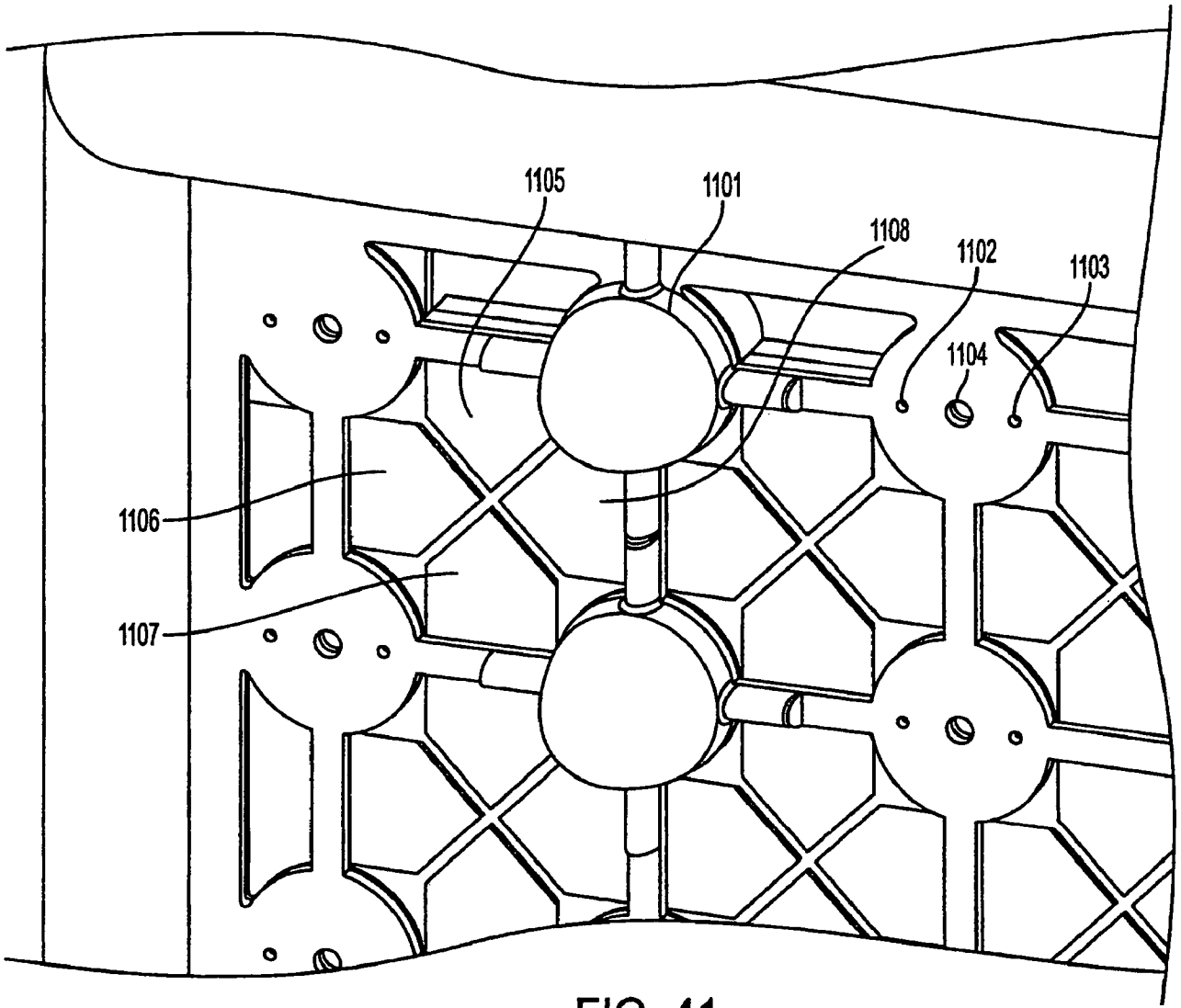
FIG. 41 shows a portion of a display element with two pixels installed.

FIG. 41 shows a portion of a display element with two pixels installed and other junctions prior to installation of pixels. One pixel 1101 is installed on the PCB. Alignment holes 1102 and 1103 can be used to align with pins 1013 and 1014 (FIG. 40) to ensure that each pixel is aligned properly. A screw hole 1104 can be used to affix the rear dome (1003 in FIG. 39) through hole 1005 (FIG. 39). In one embodiment, pixels can be easily removed or replaced as needed.

According to one variation of the invention, contrast flaps 1105, 1106, 1107, and 1108 can be positioned between the gaps in order to increase the contrast of the pixels when viewed. These flaps may be constructed of various materials such as plastic, rubber, or the like, and may be pliable so that if wind blows into the sign, the flaps will give way and permit wind flow through the sign. The flaps may be painted black or other dark colors. The flaps or similar appendages that partially obstruct the openings in the board may be formed from a single sheet that is laser-cut or perforated to correspond to the desired geometry of the board. A die-cut version of the flaps can be constructed, to eliminate the gaps and provide nearly complete contrast except for when the wind is blowing.

User Interface

The sign may be programmed in any of various ways, and a user interface can be provided to ease the creation and display of messages. Any of various types of computers (a general-purpose computer, special-purpose computer; personal digital assistant; laptop; or cell phone) can be programmed to implement the user interface, and control electronics converts the desired message into pixel control signals that are transmitted to the appropriate X and Y conductors in the sign. As explained above, it may be desirable to program a single message across all 4 display panels. Alternatively, a separate message may be programmed for two of the four panels, or a message can be programmed and displayed for a single display panel, such that different messages are viewed from different directions simultaneously. In addition, it is of course possible to use conventional "scrolling message" techniques to display messages of a length that exceed the pixel length of the display.

Figure 42:
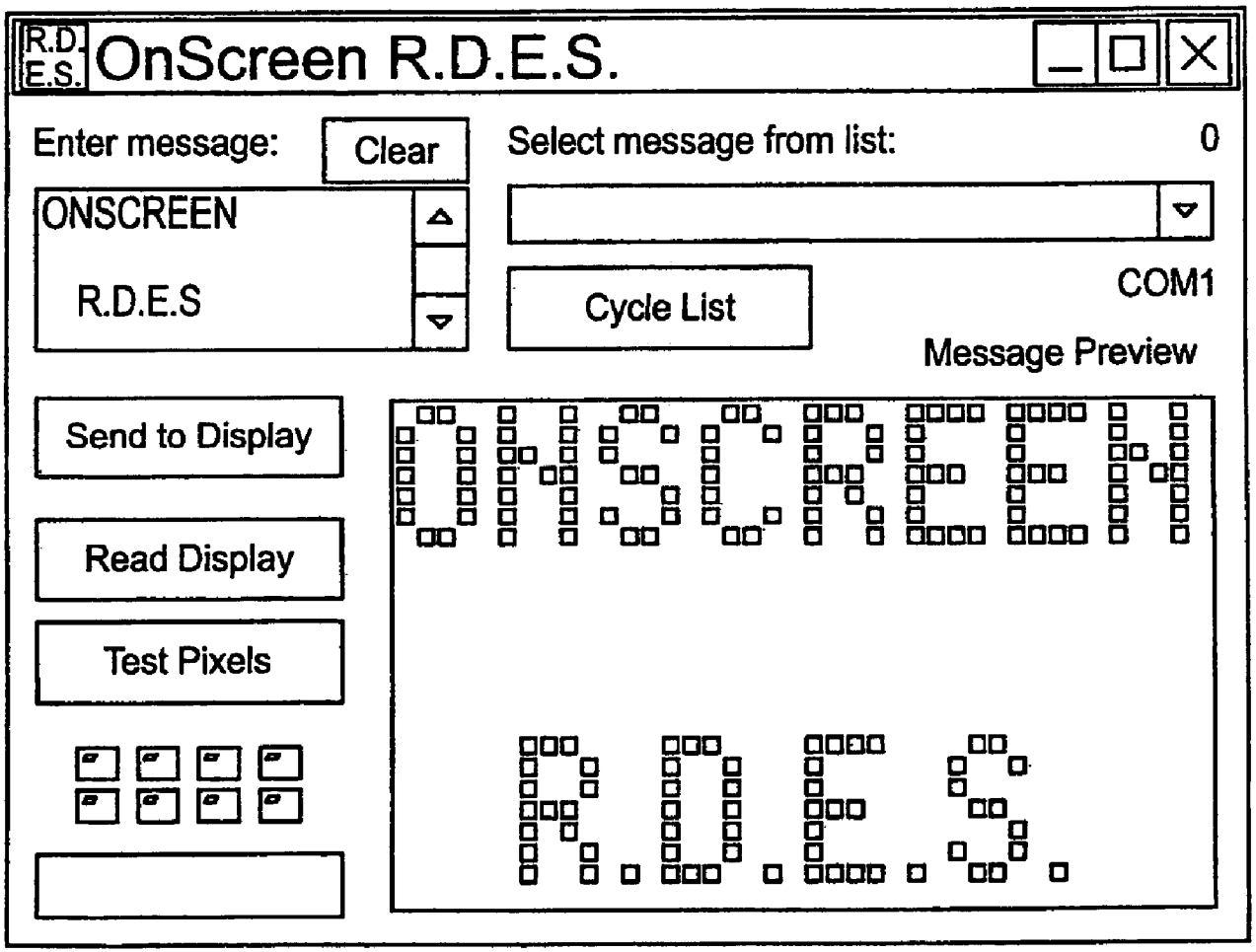
FIG. 42 shows one possible user interface for programming one or more displays.

FIG. 42 shows one possible user interface for programming one or more display elements. As shown in FIG. 42, a user can enter a message in an upper message area, and click on a Send to Display button, which causes the message (represented as characters) to be converted into individual pixels and displayed in a simulated screen area on the right side. As shown, for example, when the user types "ONSCREEN R.D.E.S." in the message area and clicks Send to Display, the computer software generates a pixel image corresponding to the message and displays it in the right portion of the user interface. If the computer is connected to the sign, this message can also be displayed on the actual sign. A Read Display button can be provided to read out the message currently displayed. This may be especially useful in remote applications (e.g., wireless) where one cannot see the sign. A Cycle List button can be provided to cycle between different messages or message sub-parts.

Although not shown in FIG. 42, a selection can also be provided to indicate the panel (e.g., #1, #2, #3, #4) on which the message should be displayed. A selection can be provided to stretch the message across all four panels, to make full use of the larger display. The user interface can be configured to communicate remotely with a display sign, such as over a cellular network, satellite, Internet, or other means.

A list of messages can be selected from a pull-down list (e.g., STOP, NO RIGHT TURN, STADIUM TRAFFIC ONLY, etc), which can be provided for ease of programming. Individual pixels can be tested by selecting an appropriate button. In one variation, pixel status can also be displayed, such that defective or inoperative pixels are indicated on the display, allowing them to be easily replaced.

A schematic for one possible design for controlling individual pixels (wherein each pixel comprises four LEDs) is included in the previously incorporated by reference provisional U.S. patent application 60/619,966.

Conclusion

Although specific examples of carrying out the invention have been described, those skilled in the art will appreciate that there are numerous other variations and permutations of the above described systems and techniques. These and other variations fall within the spirit and scope of the invention as set forth in the appended claims.

We claim:

1. An improvement for an illuminable display, wherein the illuminable display including at least, a first section, including a first plurality of light-emitting pixels, a first mesh of conductors having a first plurality of conductor intersections, each intersection of the first plurality having one of the first plurality of pixels situated thereon, and a first frame supporting the first mesh and surrounding at least a portion thereof; and a second section, including a second plurality of light-emitting pixels, a second mesh of conductors having a second plurality of conductor intersections, each intersection of the second plurality having one of the second plurality of pixels situated thereon, and a second frame supporting the second mesh and surrounding at least a portion thereof, and wherein the first section is movable with respect to the second section, the first and second sections being configurable to form a single display, and in which the improvement comprising:

a collapsible support stand supporting the single display;

a base secured to the collapsible support stand, in which the base has a cross section defined by a concave center which permits a vehicle wheel to be centered and retained on the base; and a first interconnection between the first and second sections, the first interconnection permitting relative movement of the first and second sections from a configuration in which the first and second sections are in a substantially coplanar arrangement to a configuration in which the first and second sections are at an angle to one another, wherein the first interconnection permits relative movement of the first and second sections from a configuration in which the sections are in a substantially side-by-side coplanar arrangement to a configuration in which the sections substantially overlap each other.

2. The illuminable display of claim 1, wherein the first interconnection comprises a hinge coupling an edge of the first frame to an edge of the second frame.

3. The illuminable display of claim 1, further comprising:

a third section, including a third plurality of light-emitting pixels, third mesh of conductors having a third plurality of conductor intersections, each intersection of the third plurality having one of the third plurality of pixels situated thereon, and a third frame supporting the third mesh and surrounding at least a portion thereof; and a fourth section, including a fourth plurality of light-emitting pixels, a fourth mesh of conductors having a fourth plurality of conductor intersections, each intersection of the fourth plurality having one of the fourth plurality of pixels situated thereon, and a fourth frame supporting the fourth mesh and surrounding at least a portion thereof;

a second interconnection between the third and fourth sections, the second interconnection permitting relative movement of the third and fourth sections from a configuration in which the third and fourth sections are in a substantially side-by-side coplanar arrangement to a configuration in which the third and fourth sections substantially overlap each other; and a third interconnection between the first and third sections, the third interconnection permitting relative movement of the first and third sections from a configuration in which the first and third sections are in a substantially side-by-side coplanar arrangement to a configuration in which the first and third sections substantially overlap each other.

4. The illuminable display of claim 3, wherein the first interconnection comprises a hinge coupling an edge of the first frame to an edge of the second frame, the second interconnection comprises a hinge coupling an edge of the third frame to an edge of the fourth frame, and the third interconnection comprises a hinge coupling an edge of the first frame to an edge of the third frame.

5. The illuminable display of claim 1, wherein the first mesh of conductors comprises a 2×2 mesh, the 2×2 mesh including a first set of conductor pairs oriented in a first direction and a second set of conductor pairs oriented in a second direction difference than the first direction, each intersection of the first plurality comprises an intersection of a conductor pair from the first set with a conductor pair from the second set, and each pixel of the first plurality comprises a circuit board having a plurality of light-emitting elements thereon.

6. The illuminable display of claim 5, wherein each of the light emitting pixels of the first plurality comprises a plurality of light emitting diodes (LEDs).

7. The illuminable display of claim 1, wherein the first section and the second section rotate about a common axis being substantially in line with a side of the first frame and with a side of the second frame.

8. The illuminable display of claim 7, wherein the first and second frame sides are substantially in line with separate portions of the common axis.

9. The illuminable display of claim 7, further comprising:

a third section, including a third plurality of light-emitting pixels, a third mesh of conductors having a third plurality of conductor intersections, each intersection of the third plurality having one of the third plurality of pixels situated thereon, and a third frame supporting the third mesh and surrounding at least a portion thereof; and a fourth section, including a fourth plurality of light-emitting pixels, a fourth mesh of conductors having a fourth plurality of conductor intersections, each intersection of the fourth plurality having one of the fourth plurality of pixels situated thereon, and a fourth frame supporting the fourth mesh and surrounding at least a portion thereof; and a second interconnection between the third and fourth sections, the second interconnection permitting relative movement of the third and fourth sections from a configuration in which the third and fourth sections are in a substantially coplanar arrangement to a configuration in which the third and fourth sections are at an angle to one another, and wherein the third section and the fourth section rotate about a common axis, the common axis being substantially in line with a side of the third frame and with a side of the fourth frame, the first and second frame sides are substantially in line with a first portion of the common axis, the third and fourth frame sides are substantially in line with a second portion of the common axis, and the first common axis portion is different from the second common axis portion.

10. The illuminable display of claim 9, wherein the first, second, third and fourth sections are alternately configurable as:

a single display lying in one plane, a pair of displays in which the first and second sections lie in a first plane and the third and fourth sections lie in a second plane different from the first plane, or four displays in which the first and second sections face in generally opposite directions from one another and in which the third and fourth sections also face in generally opposite directions from one another.

11. The illuminable display of claim 7, wherein each section comprises a routed printed circuit board.

12. The illuminable display of claim 7, wherein at least one section further comprises contrast flaps located between pixels.

13. The illuminable display of claim 7, wherein each pixel of the first plurality further comprises:

a base portion, and a front fairing attached to the base portion.

14. The illuminable display of claim 13, wherein each pixel of the first plurality further comprises:

a rear fairing coupled to the base by a fastener passing through the rear fairing and through a portion of a printed circuit positioned between the base and the rear fairing.

15. The illuminable display of claim 13, further comprising a plurality of light emitting diodes surface mounted to the base and having separately mounted lenses.

16. The illuminable display of claim 1, wherein the first mesh and the second mesh each comprise a plurality of openings reducing wind loading upon the display.

17. The illuminable display of claim 1, further comprising:

at least one leg attachable to the illuminable display; and a tying member configured to secure the illuminable display and attached at least one leg to a vehicle.

18. The illuminable display of claim 1, further comprising a support stand removably attached to the illuminable display, the support stand configured for stabilization by attachment to a motor vehicle.

19. The illuminable display of claim 1, further comprising a support stand removably attached to the illuminable display, and wherein the support stand includes a column and a base, and the support stand and attached illuminable display are stabilized by positioning of the base on the ground and placement of a weighted object upon on the base.

20. The illuminable display of claim 19, wherein the support stand includes a plurality of fins, and the base comprises one of the fins attached to the support stand by a hinge.

21. A collapsible support stand having stowed and deployed configurations, comprising:

a base having a weight-receiving region;

a first extension member pivotally attached to the base; and a second extension member, wherein the first extension member is generally parallel to the base in the stowed configuration and generally perpendicular to the base in the deployed configuration, the second extension member is generally parallel to the base in the stowed configuration and generally perpendicular to the base in the deployed configuration, the second and first extension members are joined in the deployed configuration to form a substantially rigid linear column having a deployed column length, the first and second extension members are arranged in the stowed configuration so as to be containable within a space having a maximum length equal to a collapsed column length, the collapsed column length being less than the deployed column length, the second extension member is adapted to retain a portable sign mountable on the support stand, the weight-receiving region is exposed in the deployed configuration so as to receive an external object to stabilize the stand, and the support stand in the stowed configuration is containable within a space having an overall stowed length, an overall stowed height and an overall stowed width, the overall stowed length being at least as great as the collapsed column length, the overall stowed length being substantially greater than the overall stowed height or the overall stowed width.

22. The collapsible support stand of claim 21, wherein:

the second extension member is nested within the first extension member, the portion of the second extension member nested within the first extension member in the stowed configuration is greater than the portion of the second extension member nested within the first extension member in the deployed configuration.

23. The collapsible support stand of claim 22, wherein second extension member is biased out of the first extension member.

24. The collapsible support stand of claim 23, further comprising a gas spring biasing the second extension out of the first extension member.

25. The collapsible support stand of claim 21, further comprising a third extension member, and wherein:

the second extension member is nested within the third extension member, the third extension member is nested within the first extension member, the portion of the second extension member nested within the third extension member in the stowed configuration is greater than the portion of the second extension member nested within the third extension member in the deployed configuration, and the portion of the third extension member nested within the first extension member in the stowed configuration is greater than the portion of the third extension member nested within the first extension member in the deployed configuration.

26. The collapsible support stand of claim 21, further comprising a latch to retain the first extension member in the deployed configuration.

27. The collapsible support stand of claim 21, further comprising a latch to retain the first extension member in the stowed configuration.

28. The collapsible support stand of claim 21, further comprising:

a first latch to retain the first extension member in the deployed configuration; and a second latch to retain the first extension member in the stowed configuration.

29. The collapsible support stand of claim 21, further comprising:

a collar siding along at least a portion of the length of the first extension member;

at least one supplemental support leg pivotally attached to the collar and configured for angular extension away from the first extension member as the collar is moved toward the pivotal attachment of the first extension member to the base; and a latch engaging the collar to retain the first extension member in the deployed configuration.

30. The collapsible support stand of claim 29, further comprising a first handle formed in the collar.

31. The collapsible support stand of claim 30, further comprising a second handle formed in the latch.

32. The collapsible support stand of claim 21, wherein the base further comprises a concave depression formed therein.

33. The collapsible support stand of claim 21, further comprising:

at least one clamp to secure the extension elements in the deployed configuration.

* * * * *